US009811965B2

(12) United States Patent
Erikawa et al.

(10) Patent No.: US 9,811,965 B2
(45) Date of Patent: Nov. 7, 2017

(54) ARTICLE EJECTING DEVICE OF AUTOMATIC VENDING MACHINE

(71) Applicant: FUJI ELECTRIC CO., LTD., Kawasaki-shi, Kanagawa (JP)

(72) Inventors: Hajime Erikawa, Kumagaya (JP); Katsuhiko Fukuda, Yokkaichi (JP); Tsutomu Iwako, Yokkaichi (JP)

(73) Assignee: FUJI ELECTRIC CO., LTD., Kawasaki-Shi (JP)

( * ) Notice: Subject to any disclaimer, the term of this patent is extended or adjusted under 35 U.S.C. 154(b) by 0 days.

(21) Appl. No.: 14/933,521

(22) Filed: Nov. 5, 2015

(65) Prior Publication Data

US 2016/0133083 A1 May 12, 2016

(30) Foreign Application Priority Data

Nov. 7, 2014 (JP) ..... 2014-227000

(51) Int. Cl.
*G07F 11/04* (2006.01)
*G07F 11/00* (2006.01)

(52) U.S. Cl.
CPC ..... *G07F 11/005* (2013.01); *G07F 11/04* (2013.01)

(58) Field of Classification Search
CPC ..... G07F 11/24
USPC ..... 221/116, 265–266, 129–130, 230
See application file for complete search history.

(56) References Cited

U.S. PATENT DOCUMENTS 7,032,776 B2 * 4/2006 Hieb ..... G07F 9/026 221/129
7,604,145 B2 * 10/2009 Percy ..... G07F 11/16 221/126
9,520,013 B2 * 12/2016 Erikawa ..... G07F 11/10

FOREIGN PATENT DOCUMENTS

JP 3781548 B2 5/2005
JP 3855573 B2 12/2006

* cited by examiner

*Primary Examiner* — Gene Crawford
*Assistant Examiner* — Ayodeji Ojofeitimi
(74) *Attorney, Agent, or Firm* — Manabu Kanesaka

(57) ABSTRACT

An article ejecting device of an automatic vending machine includes an article storage rack having an article storage passage for storing articles while being laid sideways, a base board forming one side of the article storage passage, a first stopper member movable between a protruding position in which the first stopper member protrudes toward the article storage passage and a retractable position in which the first stopper member is retracted from the article storage passage, a second stopper member movable between a protruding position in which the second stopper member protrudes toward the article storage passage and a retractable position in which the second stopper member is retracted from the article storage passage, and an outlet adjustment member forming another side of the article storage passage. The first stopper member includes an article placement surface having a holding portion holding the first vending article in a rolling manner.

10 Claims, 20 Drawing Sheets

ARTICLE EJECTING DEVICE OF AUTOMATIC VENDING MACHINE

BACKGROUND OF THE INVENTION

Technical Field

The present invention relates to an article ejecting device of an automatic vending machine mounted on an article storage rack storing articles such as beverages contained in pet bottles, bottles, and cans so that the articles are laid sideways and stacked in the up and down direction.

Related Art

In an automatic vending machine that vends articles such as beverages contained in pet bottles, bottles, and cans, the articles are separately stored in accordance with the cold/hot state thereof in an article storage room of a main cabinet as a heat insulation cabinet, a plurality of article samples is horizontally arranged for exhibition in a display room of an outer door, and the articles are selected in accordance with the operation of article selection buttons respectively corresponding to the article samples. This kind of automatic vending machine will be described with reference to FIG. 18.

As illustrated in FIG. 18, the automatic vending machine includes a main cabinet 100 of which a front surface is opened, and an outer door 106 which is supported by the front surface of the main cabinet 100 so as to be openable/closable by a hinge, and the main cabinet 100 is provided as a heat insulation cabinet in which a heat insulation board formed of urethane foam is disposed on inner surfaces 101*a*, that is, an upper wall, left and right side walls, a rear wall, and a bottom wall of a steel cabinet. The inside of the article storage room surrounded by the heat insulation board of the main cabinet 100 is defined by a heat insulation partition plate 102 into a plurality of article storage rooms 103, 104, and 105 in the left and right direction. In this example, an article storage rack 108 having an article storage passage meandering and called a serpentine type is provided in each of the article storage rooms 103, 104, and 105. An inner door 107 is disposed between the front surface of the article storage room of the main cabinet 100 and the outer door 106 supported by the front surface of the main cabinet 100 so as to be openable/closable, and in this example the inner door 107 is divided into the upper and lower parts. The lower inner door 107 is provided with an article ejection opening having an ejection door 107*a* at the position corresponding to a chute 109 through which the articles are sent out from the article storage racks 108 of the article storage rooms 103, 104, and 105. The ejection door 107*a* is drooped while the upper end thereof is journaled and closes the article ejection opening by the own weight so as to prevent cool or warm air from flowing outward. Then, the ejection door is pressed and opened by the article ejected through the chute 109 so that the article is sent to an article ejection opening 106*a* of the outer door 106. Additionally, the upper area of the front surface of the outer door 106 is formed as a display room covered by a transparent plate so as to exhibit the article samples therein, the front surface of the transparent plate is provided with an article selection button unit, and the article selection button unit is provided with article selection buttons corresponding to the exhibited article samples. Further, the front surface of the outer door 106 is provided with a coin slot, a paper money slot, a coil return slot, a return lever, an article ejection opening, a handle lock, and the like.

As illustrated in FIG. 19, the article storage rack 108 includes a pair of left and right rack side plates 81 and 81 which is formed by a thin flat steel plate, a plurality of rows (five rows in the drawing) of meandering article storage passages (article columns) 83 which is defined in the front to back direction between a pair of curved rail segment rows 82 provided in the rack side plates 81 and 81 so as to be displaced by a half pitch in the up and down direction, a top tray 84 which connects an article slot SL (see FIG. 18) provided in the front surface opening of the main cabinet 100 to the upper end inlet of the article storage passage 83 from the second row, an article ejecting device 10 which is disposed at the lower end outlet of each article storage passage 83, and outlet adjustment members 10A that are disposed so as to face each other with the article ejecting device 10 and the article storage passage 83 interposed therebetween. In this example, the article storage rack 108 includes a front-stage-side article storage rack 108*a* which includes two rows of article storage passages 83 and a rear-stage-side article storage rack 108*b* which includes three rows of article storage passages 83, where these article storage racks are provided as a double article storage rack from the rear side. Here, rack-side hook metal pieces 811 and 811 provided in the upper ends of the pair of left and right rack side plates 81 and 81 of the article storage racks 108*a* and 108*b* are fixed by locking to a body-side hook metal piece (not illustrated) provided in the ceiling of the article storage room. Further, in order to handle the articles (for example, a canned beverage of 170 ml and a pet bottled beverage of 500 ml) having different sizes in such an automatic vending machine, the article storage rack 108 is prepared in response to the horizontal width corresponding to the length of the article (the width in the article storage passage width direction) so as to handle different types (generally, two kinds of articles, that is, a comparatively short article and a comparatively long article). In that case, in order to uniformly arrange the short articles on one of the pair of left and right rack side plates 81, a movable plate (not illustrated) movable close to and away from the other rack side plate 81 is disposed in the other rack side plate 81, and the movement of the movable plate is adjusted in response to the length of the article so as to set the article storage passage width.

As illustrated in FIG. 20, the article ejecting device 10 includes a first stopper member 2 that is journaled so as to be movable close to and away from the article storage passage from a rectangular opening portion 11 provided in a thin box-shaped base board 1 and is movable between a protruding position in which the first stopper member protrudes toward the article storage passage 83 so as to hold an article (a vending article) as a first vending target and a retractable position in which the first stopper member is retracted from the article storage passage 83 so as to release the holding of the vending article, a second stopper member 3 that is journaled so as to be movable close to and away from the article storage passage 83 from the opening portion 11 of the base board 1 and is movable to a protruding position in which the second stopper member protrudes toward the article storage passage 83 so as to hold an article (a next vending article) as a second vending target subsequent to the vending article while being urged toward a retractable position in which the second stopper member is retracted from the article storage passage 83, a link mechanism 6 that moves the first stopper member 2 and the second stopper member 3 between the protruding position and the retractable position, and a solenoid 5 that drives the link mechanism 6. Here, the first stopper member 2 and the second stopper member 3 are made to alternately move close to and away from the article storage passage 83 through the link mechanism 6 in accordance with the energizing of the solenoid 5, and hence the vending article is sent out after the next vending article is held by the second stopper member 3.

Further, the article ejecting device 10 is fixed to upper and lower pin members P and P provided in the pair of left and right rack side plates 81 and 81, and a synthetic resinous holder 9 provided in the lower edge of the base board 1 is made to engage with and separate from the lower pin member P. In this way, the article ejecting device is removably provided. Further, in the article ejecting device 10, a bearing member 4*a* is disposed at the center portion of the opening portion 11 provided in the base board 1 in the left and right direction so as to slidably support the center portions of rotation shafts 20 and 30 of the first stopper member 2 and the second stopper member 3 and an upper link pin 61 and a lower link pin 62 slid by the link mechanism 6 driven by the solenoid 5 so that the first stopper member 2 and the second stopper member 3 move close to and away from the article storage passage (for example, see Japanese Patent No. 3855573).

Additionally, in FIG. 20, a sellout detection switch 8 includes a micro switch 8A and an article detection lever 8B protruding toward the article storage passage 83. The sellout detection switch 8 is obtained by attaching the micro switch 8A and the article detection lever 8B to a frame-shaped attachment stand 8C. The article detection lever 8B is rotatably journaled by the attachment stand 8C and is urged toward the article storage passage 83 by a twist coil spring 8D. The spring force of the twist coil spring 8D urging the article detection lever 8B toward the article storage passage 83 is set to a force in which the article detection lever 8B is retracted along the flat surface of the base board 1 so as to allow the passage of the article and the article detection lever 8B protrudes toward the article storage passage 83 after the passage of the article when the article falling through the article storage passage 83 contacts the article detection lever 8B protruding toward the article storage passage 83. Here, as illustrated in FIG. 20, the article detection lever 8B is disposed in the upper area of the second stopper member 3. This arrangement is set to prevent a problem in which the article detection lever 8B protruding toward the article storage passage 83 interferes with the second stopper member 3 moving between the protruding position and the retractable position to thereby give a bad influence on the second stopper member 3. For this reason, the article detection lever 8B is configured to detect the existence of the next vending article stacked on the vending article. When the next vending article exists, the article detection lever is pressed by the next vending article so as to be retracted along the flat surface of the base board 1. Meanwhile, when the next vending article does not exist (the sold-out state), the article detection lever is rotated by the twist coil spring 8D so as to protrude toward the article storage passage 83 and to operate the micro switch 8A. In other words, the article detection lever 8B is configured to detect whether any article remains in the article storage passage 83.

Incidentally, the article loading operation in the automatic vending machine including such an article ejecting device is performed in a manner such that the article is input from the article slot SL (see FIG. 18) provided in the front surface opening of the main cabinet 100 while the article is laid sideways. After the installation of the automatic vending machine, the article input first from the article slot SL moves through the meandering article storage passage 83 and is held as the vending article while being laid sideways by the first stopper member 2 of the article ejecting device 10 locked at the protruding position in which the first stopper member protrudes toward the article storage passage 83. Next, the second input article is stacked on the vending article held by the first stopper member 2 and corresponds to the next vending article. Then, the subsequent next input articles are stacked on the next vending article one by one, and the articles are stored in the article storage passage 83 while being laid sideways.

Here, the article storage passage 83 is provided in the upper area of the article ejecting device 10 in a meandering shape, and the article storage passage 83 is provided in a linear shape in the area of the article ejecting device 10. In this way, the reason why the article storage passage 83 is provided in a linear shape in the area of the article ejecting device 10 is because the second stopper member 3 is made to protrude toward the article storage passage 83 when the article is ejected in order to eject only the vending article while reliably holding the next vending article against the outlet adjustment member 10A. Thus, since the article storage passage 83 is provided in a linear shape in the area of the article ejecting device 10, a space is provided in which the loaded article stands up from the laid state. In this case, when the first loaded article presses the article detection lever 8B back so that the article stands up due to the impact generated when the article falls onto the first stopper member 2, the article contacts the article detection lever 8B returned to protrude toward the article storage passage 83 so that the standing thereof is disturbed. Thus, the first loaded article is placed on the first stopper member 2 while being laid sideways as the vending article. Meanwhile, when the second input next vending article presses the article detection lever 8B back and falls onto the vending article, the next vending article is rebounded to stand up, the article stands up since the article detection lever 8B is pressed back by the next vending article so as to be retracted from the article storage passage 83. In this way, the phenomenon in which the second input next vending article falls onto the vending article and is rebounded so as to stand up particularly easily occurs in the case of the article in which a beverage container is formed so that a spout is thinner than a body portion. As described above, when the article stands up in the article storage passage 83 of the area of the article ejecting device 10, the article cannot be ejected normally. For this reason, there is known a configuration in which the article storage passage 83 in the upper area of the article ejecting device 10 is provided with a rebounding prevention member that prevents an article from being rebounded from the area of the article ejecting device 10 so that the article is held while being laid sideways (for example, see Japanese Patent No. 3781548). The rebounding prevention member is urged toward a protruding position in which the rebounding prevention member protrudes toward the article storage passage 83 due to a coil spring and is retracted from the article storage passage 83 so as to allow the passage of the article when the article contacts the rebounding prevention member.

Additionally, the phenomenon in which the article stands up occurs when the article is first loaded after the automatic vending machine is installed or the article is first loaded for the replacement of the article in the article storage rack 108 (when the article left in the article storage passage 83 is sent out by the operation of the article ejecting device 10 and a new article is loaded). Alternatively, the phenomenon also occurs when the article is loaded in the sold-out state although the vending article is left. Further, the state in which the article stands up includes the inclined state in which the article is inclined while standing up from the laid state in addition to the state in which the article completely stands up.

PRIOR PATENT

Japanese Patent No. 3855573

Japanese Patent No. 3781548

Incidentally, in the configuration disclosed in Japanese Patent No. 3781548, since the upper area of the article ejecting device 10 is provided with the rebounding prevention member, it is possible to hold the article while being laid sideways by preventing the article from being rebounded from the area of the article ejecting device 10, and hence to excellently ensure the normal ejecting operation of the article ejecting device 10. However, there is a need to additionally provide the rebounding prevention member and the coil spring urging the rebounding prevention member toward the protruding position in which the rebounding prevention member protrudes toward the article storage passage 83 in order to prevent the article from being rebounded from the area of the article ejecting device 10. In this case, the number of additional parts needs to be set in response to the number of the article ejecting device 10 mounted on the article storage rack 108 of the automatic vending machine. Thus, a problem arises in that an increase in number of parts and cost inevitably occurs.

The invention is made in view of the above-described circumstance, and an object thereof is to provide an article ejecting device of an automatic vending machine capable of suppressing the standing of an article without causing an increase in cost.

In order to attain the above-described object, the present inventors found out that the next vending article was rebounded in the article ejecting device of the related art due to the following configuration as a result of the examination on the phenomenon in which the next vending article collided with the vending article held by the first stopper member when the article was loaded. This configuration will be described with reference to the schematic diagram of the article ejecting device of the related art illustrated in FIG. 15E. Such an article ejecting device has a structure in which the first stopper member 2 is inclined downward in relation to the horizontal line while protruding toward the article storage passage 83 so as to hold the vending article G1 and takes an inclined posture in which an angle β intersecting the outlet adjustment member 10A becomes an acute angle. This is because the vending article G1 is immediately ejected by the movement of the first stopper member 2 from the protruding position to the retractable position when the vending article G1 placed on the first stopper member 2 and leaning against the outlet adjustment member 10A is ejected by the movement of the first stopper member 2 from the protruding position to the retractable position. Accordingly, a variation in ejecting time does not occur, that is, a constant vending time is set. For this reason, the vending article G1 placed on the first stopper member 2 is held immovably while being supported at two points P1 and P2 as the contact points with the article placement surface 21A of the first stopper member 2 and the outlet adjustment member 10A. When the next vending article G2 falls onto the vending article G1 which is immovable in this way, an impact generated when the next vending article G2 collides with the vending article G1 is not distributed and is directly applied as a reaction force to the next vending article, so that the next vending article is largely rebounded. That is, it is turned out that the article ejecting device of the related art causes the standing of the article on the ground that the vending article G1 placed on the first stopper member 2 is immovably held while being supported at two points P1 and P2 as the contact points in the article placement surface 21A of the first stopper member 2 and the outlet adjustment member 10A. Here, if the vending article G1 placed on the first stopper member 2 is movably held, that is, the vending article is movable in a rolling manner in the event of an external force, the impact generated when the next vending article G2 collides with the vending article G1 can be distributed and hence the standing of the article can be suppressed. Consequently, the invention is made in which the vending article G1 is held in a rolling manner by the first stopper member 2 to be described below.

SUMMARY OF THE INVENTION

Specifically, to attain the above-described object, a first aspect of the invention provides an article ejecting device of an automatic vending machine mounted on an article storage rack storing articles while being laid sideways and stacked in an article storage passage extending in the up and down direction. The article ejecting device comprises a base board forming one side of the article storage passage; a first stopper member movable between a protruding position in which the first stopper member protrudes toward the article storage passage so as to hold an article (a vending article) as a first vending target and a retractable position in which the first stopper member is retracted from the article storage passage so as to release the holding of the vending article; a second stopper member movable between a protruding position in which the second stopper member protrudes toward the article storage passage so as to hold an article (a next vending article) as a second vending target and a retractable position in which the second stopper member is retracted from the article storage passage; and an outlet adjustment member forming another side of the article storage passage. The first stopper member includes an article placement surface having a holding portion holding the first vending target in a rolling manner so that the first vending target does not contact the outlet adjustment member when only the first vending target is placed on the article placement surface without the next vending target stacked thereon.

Further, according to a second aspect of the invention, in the article ejecting device of the automatic vending machine according to the first aspect, the holding portion is an inverse trapezoidal recess portion formed on the article placement surface of the first stopper member.

Further, according to a third aspect of the invention, in the article ejecting device of the automatic vending machine according to the first aspect, the holding portion is a circular-arc recess portion formed on the article placement surface of the first stopper member.

Further, according to a fourth aspect of the invention, in the article ejecting device of the automatic vending machine according to the first aspect, the holding portion is a recess portion formed by an upward protruding protrusion portion provided in the front end of the first stopper member.

According to the first aspect of the invention, the article ejecting device of the automatic vending machine is mounted on the article storage rack storing articles while being laid sideways and stacked in the article storage passage extending in the up and down direction. The article ejecting device comprises the base board forming one side of the article storage passage; the first stopper member movable between the protruding position in which the first stopper member protrudes toward the article storage passage so as to hold the article (a vending article) as a first vending target and the retractable position in which the first stopper member is retracted from the article storage passage so as to release the holding of the vending article; and the second stopper member movable between the protruding position in which the second stopper member protrudes toward the article storage passage so as to hold the article (a next vending article) as a second vending target and the retractable position in which the second stopper member is retracted from the article storage passage, wherein the article ejecting device is disposed so as to face the outlet adjustment member forming the other side of the article storage passage, and the article placement surface of the first stopper member is provided with the holding portion holding the vending article in the rolling manner so that the vending article does not contact the facing passage forming member when only the vending article is placed on the article placement surface without the next vending article stacked thereon. Accordingly, since the vending article placed on the holding portion of the first stopper member is held in a rolling manner, the vending article rolls while absorbing and distributing the impact generated when the next vending article falls onto the vending article. Accordingly, since the reaction force generated from the next vending article is suppressed, the rebounding of the next vending article can be prevented. Thus, there is an effect that the standing of the next vending article can be prevented only by the improvement in the first stopper member.

BRIEF DESCRIPTION OF DRAWINGS

FIGS. 5A to 5C illustrate a bearing portion of FIG. 4, wherein FIG. 5A is a perspective view illustrating a state where a bearing member is separated from a bearing holding portion of the bearing portion, and FIGS. 5B and 5C are perspective views illustrating the bearing member when viewed from a different direction;

FIGS. 15A to 15E are schematic diagrams of FIG. 14, wherein FIG. 15A is a diagram illustrating a vending article loading operation, FIG. 15B is a diagram illustrating a next vending article loading operation, FIGS. 15C and 15D are diagrams illustrating an operation of displacing a next vending article falling direction, and FIG. 15E is a diagram illustrating an article ejecting device of the related art as a comparative example;

DETAILED DESCRIPTION OF THE INVENTION

Figure 18:
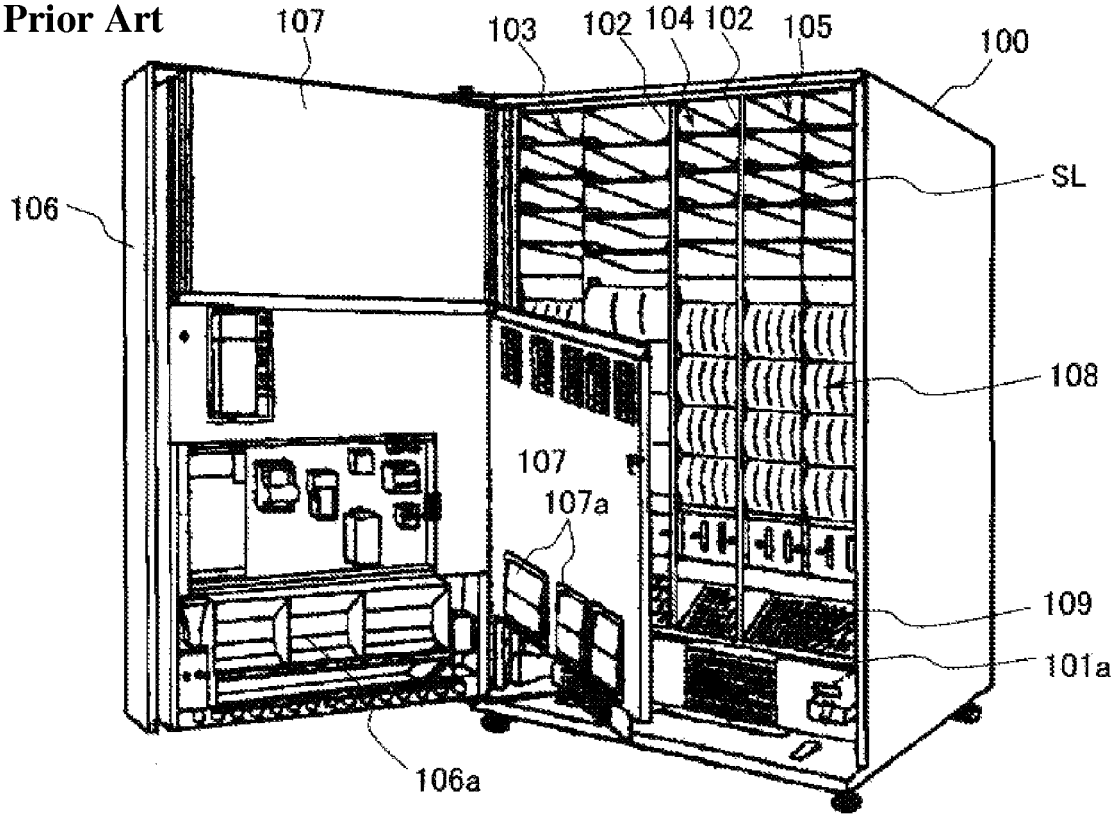
FIG. 18 Prior Art
FIG. 18 is a perspective view illustrating a state where an outer door of an automatic vending machine as a target of the invention is opened.
Figure 19:
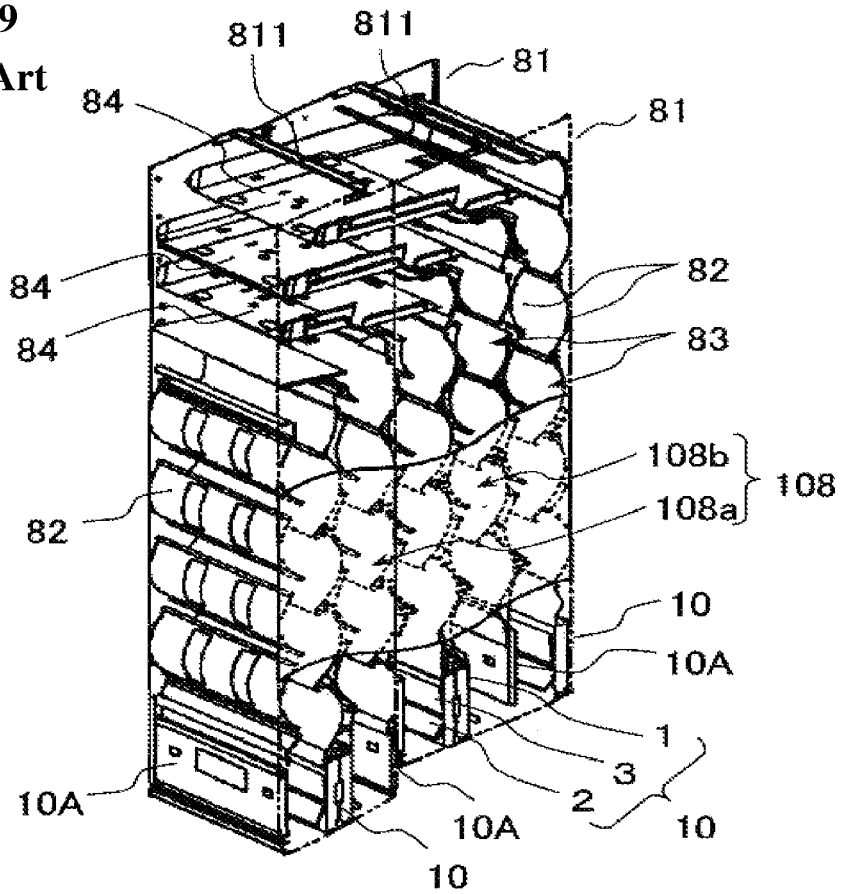
FIG. 19 Prior Art
FIG. 19 is a perspective view of an article storage rack of the automatic vending machine of FIG. 18.
Figure 20:
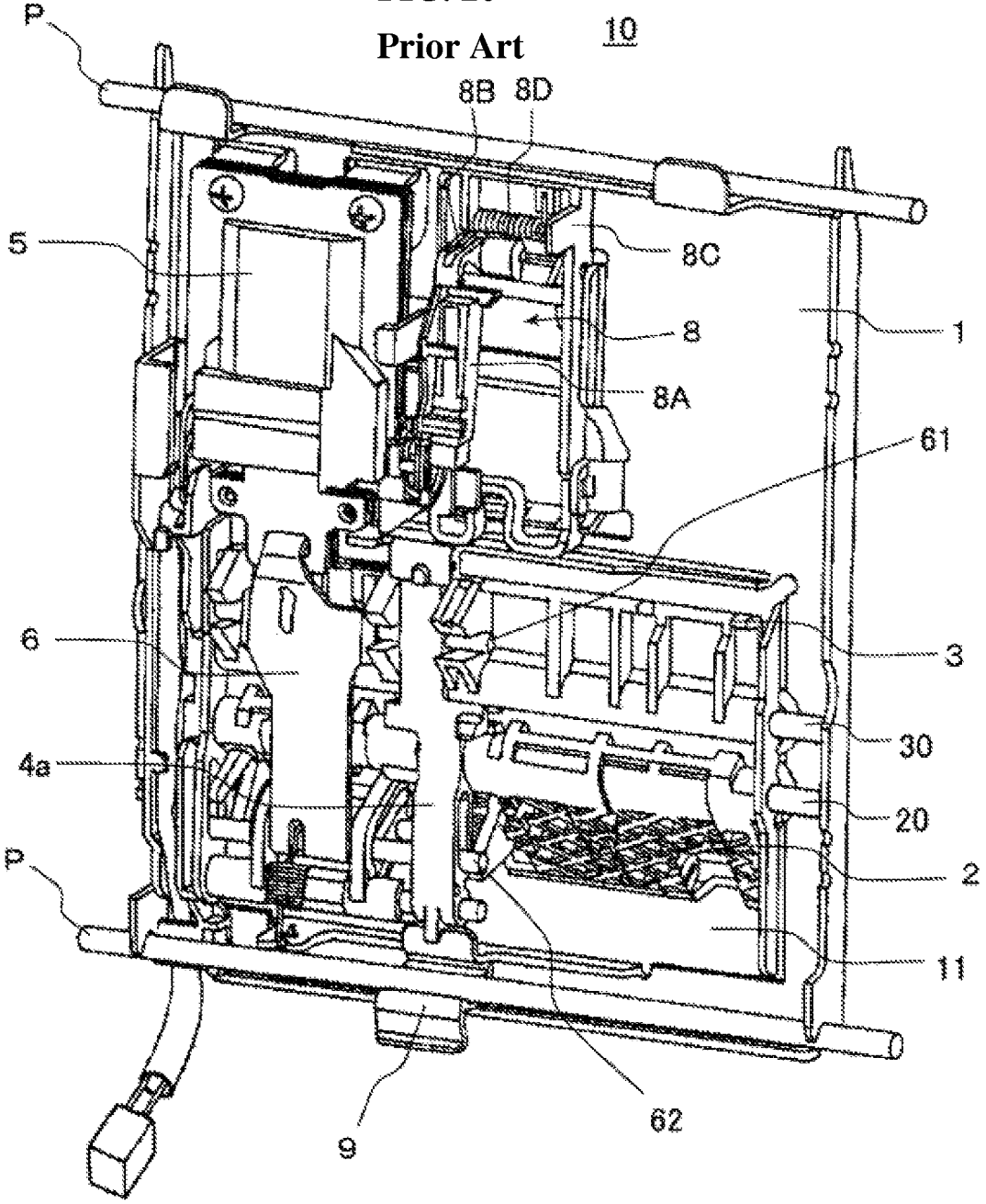
FIG. 20 Prior Art
FIG. 20 is a perspective view of the article ejecting device provided in the article storage rack of FIG. 19.

Hereinafter, an article ejecting device of an automatic vending machine according to an embodiment of the invention will be described in detail with reference to the accompanying drawings. Further, the same reference numerals will be given to the components having the same functions illustrated in FIGS. 18 to 20. Here, the front and rear surfaces of the article ejecting device respectively indicate a surface facing an article storage passage 83 (see FIG. 19) and a surface opposite to the article storage passage 83, and the front and rear surfaces of first and second stopper members respectively indicate a surface facing the article storage passage 83 moved to a retractable position and a surface opposite to the article storage passage 83. Further, a case will be described in which the article ejecting device of the embodiment is mounted on an article storage rack for an article having a comparatively long size.

As illustrated in FIGS. 1 to 5C, an article ejecting device 10 includes a rectangular plate-shaped base board 1 which is formed by a steel plate. The lower half area of the base board 1 is provided with an opening portion 11 (see FIG. 3) which is narrow compared with the horizontal width of the base board 1 and closing portions 1A and 1A which are adjacent to the left and right sides of the opening portion 11, and the upper half area of the base board 1 is provided with an opening portion 12 (see FIG. 3) which is provided at the center position in the left and right direction. The opening portion 11 is formed in a substantially rectangular shape except for an upper area provided with extension portions 11*a* and 11*a* extending in the left and right direction. Further, recess portions 1B and 1B which receive a first stopper member 2 to be described later are provided in the lower areas of the closing portions 1A and 1A of the base board 1, and the spaces of the recess portions 1B and 1B communicate with the opening portion 11 while no wall exists between the recess portions 1B and 1B and the opening portion 11. Further, the base board 1 is integrally provided with a bearing portion 4 which is provided in a shape bridged between the upper and lower edges of the opening portion 11. The bearing portion 4 is provided at a position closer to any one (which corresponds to the right direction in FIG. 1 and the left direction in FIG. 2) of the left and right sides in relation to the center of the left and right direction of the base board 1. Here, in a case where two article ejecting devices 10 are combined with each other while being disposed back to back, both bearing portions 4 are provided without any interference therebetween. Further, the base board 1 is provided with a guide protrusion 13 which is provided at a position above the opening portion 11 so as to protrude toward the article storage passage 83.

Figure 2:
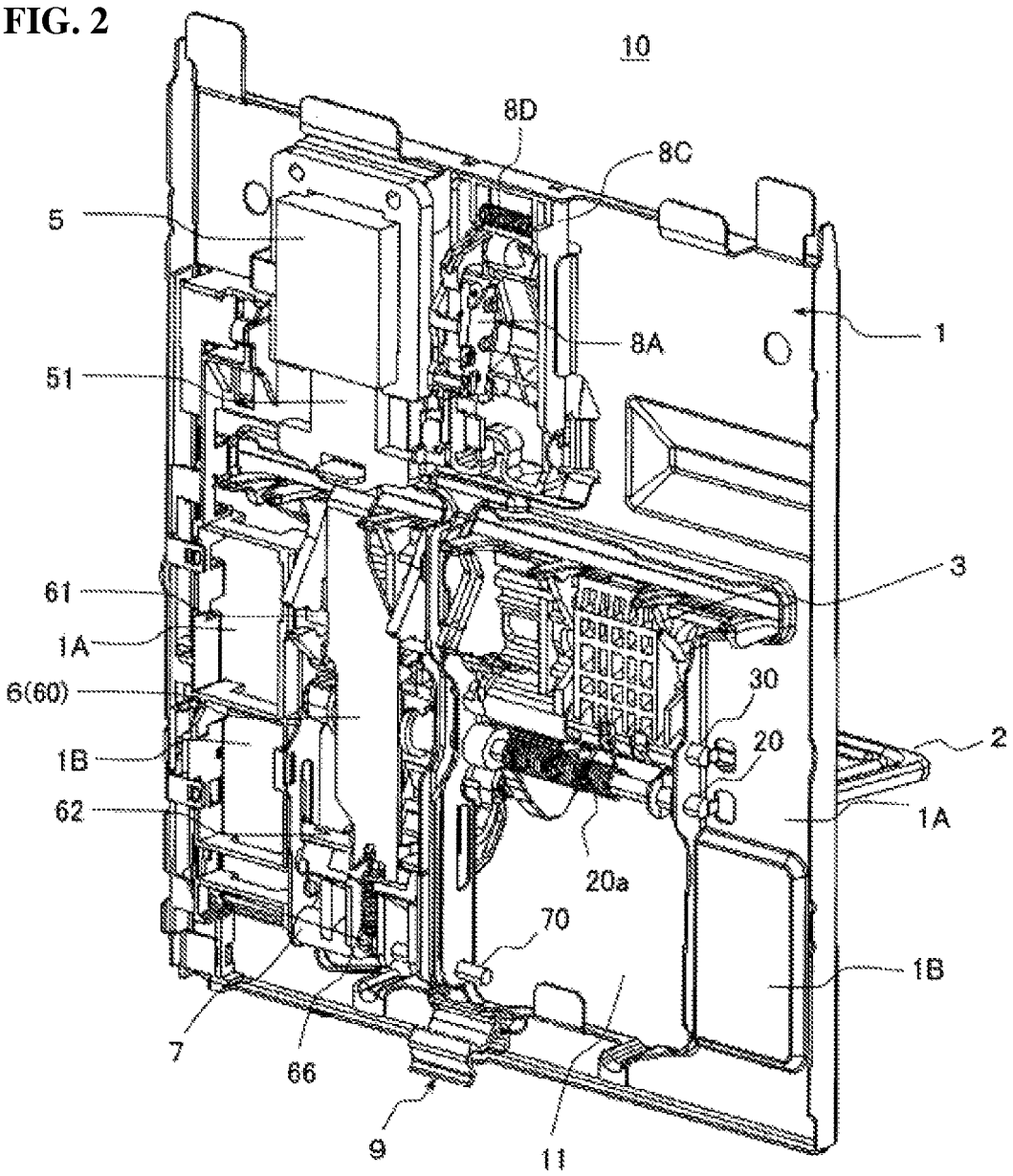
FIG. 2 is a rear perspective view of the article ejecting device of FIG. 1.

As illustrated in FIG. 2, a first stopper member 2 and a second stopper member 3 are journaled by the rear surface of the base board 1. Here, a solenoid 5 as a driving unit, a link mechanism 6, a rotation stopper 7, and a sellout detection switch (a sellout detector) 8 are disposed on the rear surface of the base board, and a closing plate 20' is disposed on the front surface of the base board 1 so as to face the article storage passage 83.

The bearing portion 4 is arranged between the upper and lower edges of the opening portion 11 of the base board 1. The bearing portion 4 supports ends (to be described later) of the link mechanism 6 and the rotation stopper 7, and supports the center portions of the shafts (to be described later) of the first stopper member 2 and the second stopper member 3. Here, the other ends of the shafts are supported by a flange 11B (see FIG. 4) of the opening portion 11 provided at the left edge of the opening portion 11 of the base board 1 so as to protrude toward the rear surface of the base board 1. Further, since the bearing portion 4 and the flange 11B have a substantially symmetrical shaft supporting configuration, in the description below, the configuration of the flange 11B will be described after the description of the bearing portion 4.

Figure 3:
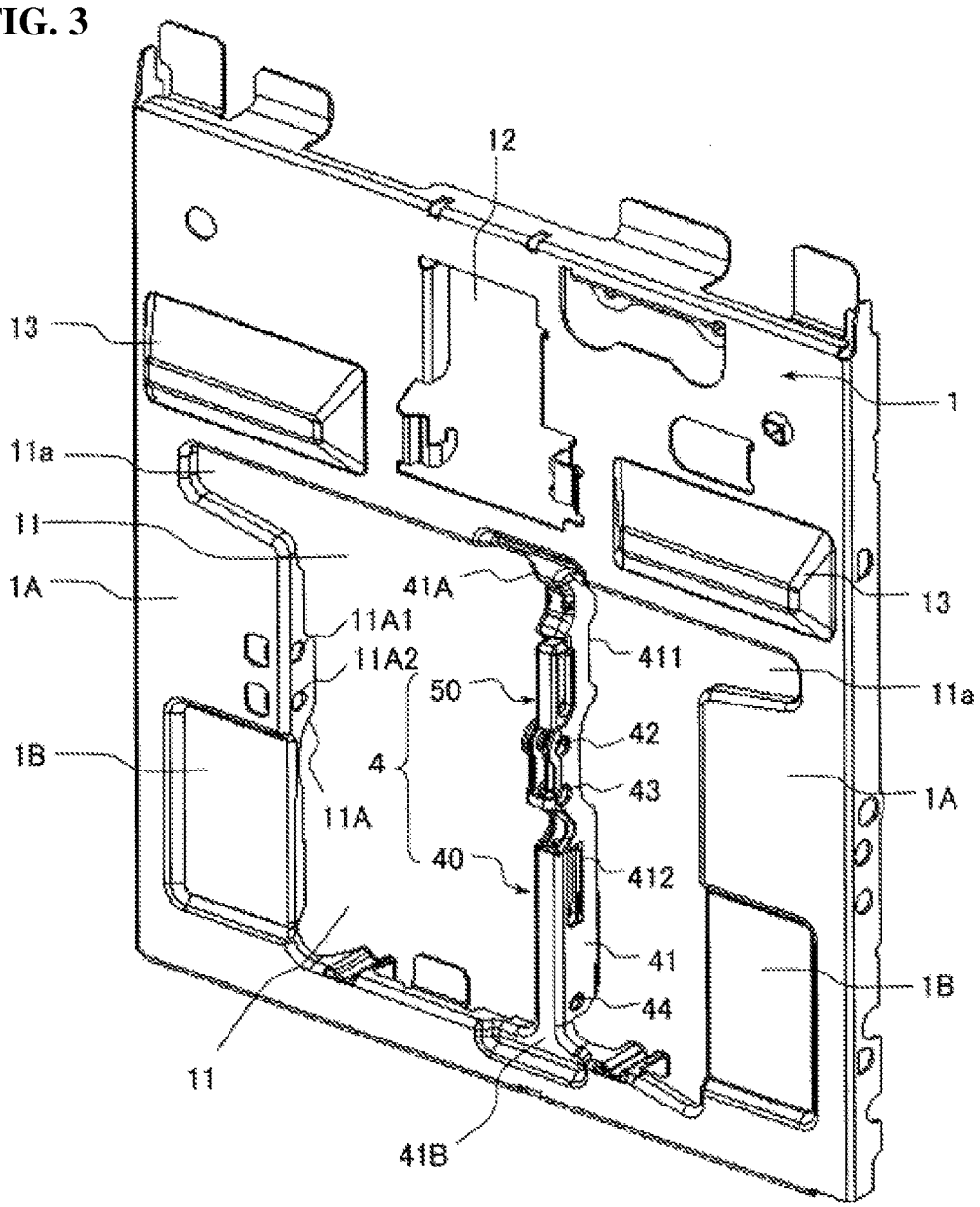
FIG. 3 is a front perspective view of abase board of the article ejecting device of FIGS. 1 and 2.
Figure 4:
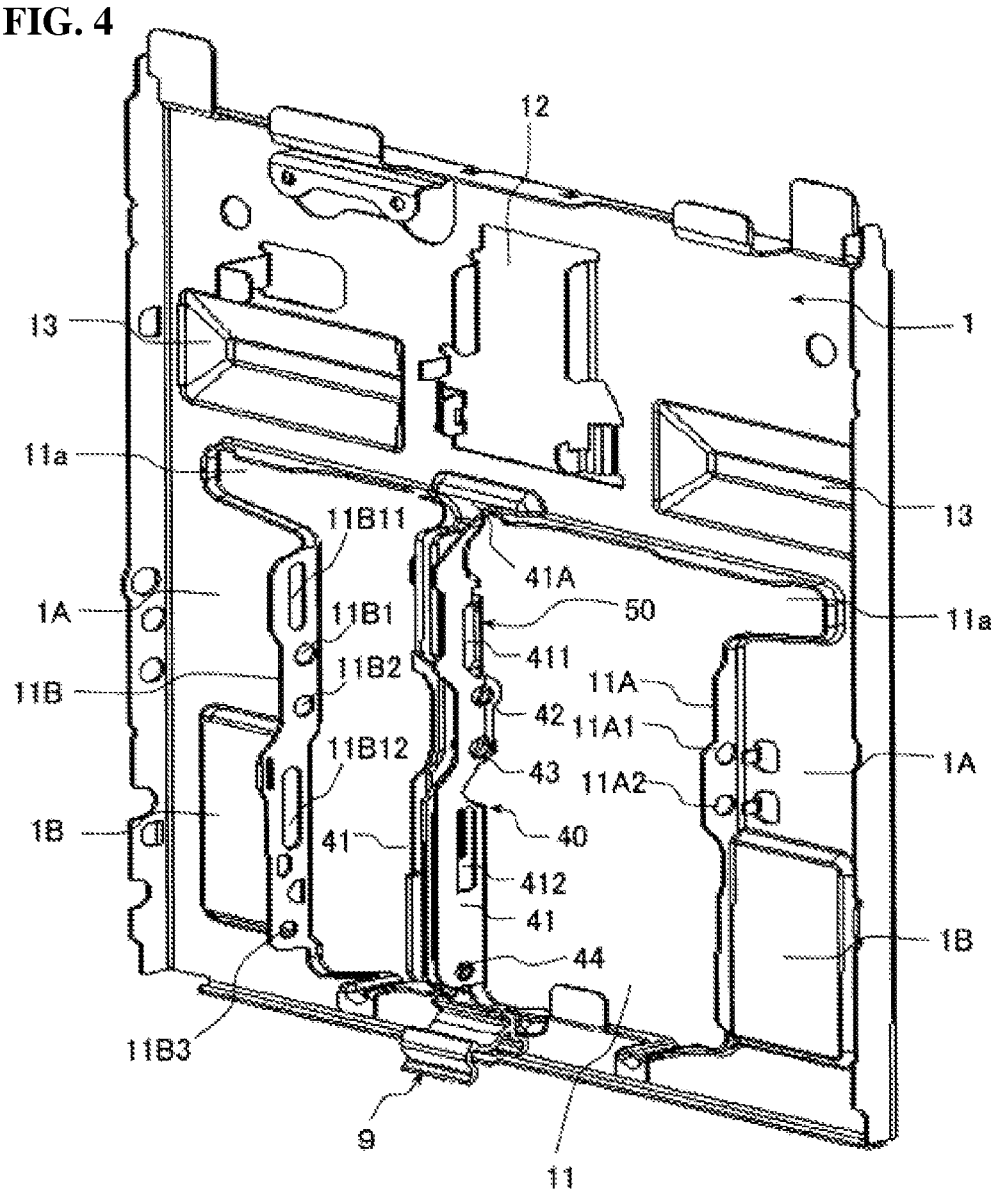
FIG. 4 is a rear perspective view of the base board of the article ejecting device of FIGS. 1 and 2.
Figure 5A:
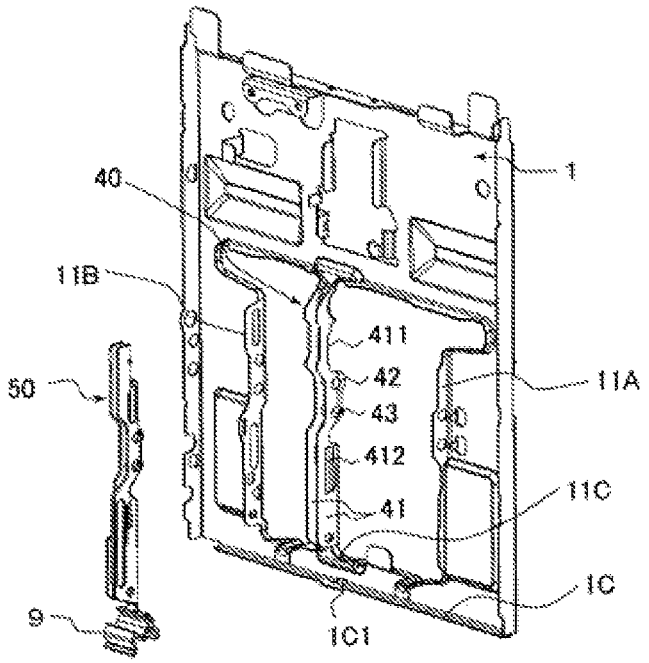
Figure 5B:
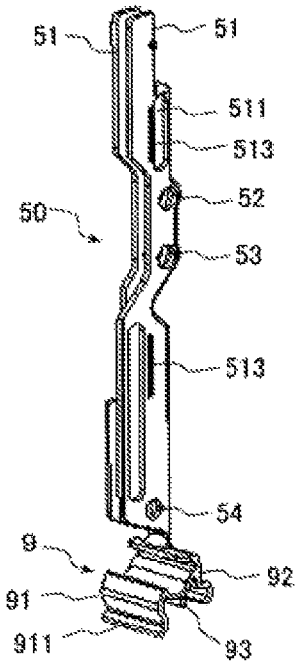
Figure 5C:
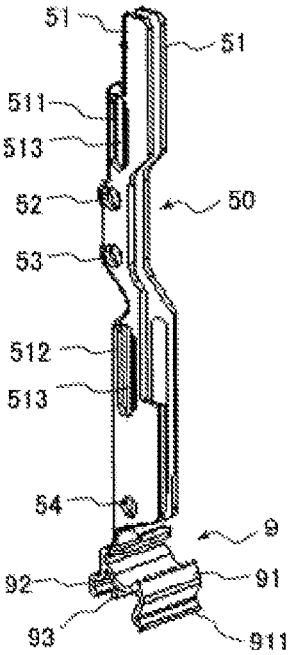

The bearing portion 4 includes a bearing holding portion 40 which is integrated with the base board 1 and a bearing member 50 which is formed of synthetic resin and is attached to the bearing holding portion 40. FIGS. 3 and 4 illustrate a state where the bearing member 50 is attached to the bearing holding portion 40 integrated with the base board 1, and FIGS. 5A to 5C illustrate a state where the bearing member 50 is separated from the bearing holding portion 40. The bearing holding portion 40 is provided so that a part of the plate surface of the base board 1 is left and is integrated with the base board 1 so as to divide the opening portion 11 into left and right opening portions when the opening portion 11 is provided in the base board 1. Here, the bearing holding portion is provided in a bridge shape laid between the upper and lower edges of the opening portion 11 by the extrusion toward the rear surface.

The bearing holding portion 40 is integrally connected to the upper and lower edges of the opening portion 11 provided in the base board 1 through coupling arms 41A and 41B (see FIGS. 3 and 4) corresponding to the bridge piers of the bridge so that the bridge beam portion is swollen toward the rear surface by the flat plate surface of the base board 1. Further, locking flanges 41 and 41 (see FIGS. 5A to 5C) are provided by bending both left and right sides of the bridge beam portion toward the rear surface. Here, each of the locking flanges 41 and 41 is provided so that the lower half area of the bridge beam portion is provided in a U-shape and the upper half area thereof is provided in a shape obtained by cutting and opening the bottom surface of the U-shaped portion. The upper half areas of the locking flanges 41 and 41 are provided with notches 411 and 411 which are recessed toward the rear surface, and the lower half areas of the locking flanges 41 and 41 are provided with elongated holes 412 and 412 which extend in the up and down direction. Further, two support shaft holes 42 and 43 are provided at each of the center positions of the locking flanges 41 and 41 so as to be separated from each other in the up and down direction. Further, a shaft hole 44 is also provided at each of the lower positions of the locking flanges 41 and 41.

As illustrated in FIGS. 5A to 5C, the bearing member 50 that forms the bearing portion 4 is molded by synthetic resin so as to have substantially the same U-shaped cross-section as the bearing holding portion 40 and to be integrated with a holder 9. The bearing member 50 is provided so that the outline dimension is much smaller than that of the bearing holding portion, and is fitted between the locking flanges 41 and 41 of the bearing holding portion 40. Both U-shaped bridge pieces of the bearing member 50 are provided as bearing pieces 51 and 51. Here, elongated holes 511 and 511 which extend in the up and down direction are provided at the areas above the bearing pieces 51 and 51, and an elongated hole 512 which extends in the up and down direction is provided in the area below one bearing piece 51 (the left bearing piece in FIGS. 5A to 5C) among the bearing pieces 51 and 51. The elongated holes 511 and 511 and the elongated hole 512 respectively correspond to the recessed notches 411 and 411 provided in the locking flanges 41 and 41 and the elongated holes 412 and 412. Further, the outer walls of the bearing pieces 51 and 51 are provided with a plurality of locking protrusions 513 which protrudes outward. The locking protrusion 513 is provided in a pattern shape which increases in thickness as it goes toward the rear surface (toward the free ends of the bearing pieces 51 and 51). Further, two support shaft holes 52 and 53 are provided at each of the center positions of the bearing pieces 51 and 51 so as to be separated from each other in the up and down direction. Furthermore, shaft holes 54 and 54 are also provided at the lower positions of the bearing pieces 51 and 51.

As already known, the holder 9 integrated with the bearing member 50 engages with (or separates from) a pin member P (see FIG. 20) provided in the article storage rack 108 so as to install the article ejecting device 10 to the article storage rack 108 (or separates the article ejecting device 10 from the article storage rack 108). The holder 9 is generally provided as a part separated from the bearing member 50 and is fixed to the base board 1 by locking. However, in the embodiment, the holder is molded by synthetic resin so as to be integrated with the bearing member 50. The holder 9 includes a hook piece 91 which engages with and separates from the pin member P, a press-insertion portion 92 which is press-inserted between a lower flange 1C of the base board 1 and a lower flange 11C of the opening portion 11, and a protrusion piece 93 which is fitted into a locking hole 1C1 opened to the lower flange 1C of the base board 1. The hook piece 91 of the holder 9 is provided with a pinch piece 911 which extends downward. Further, the protrusion piece 93 is provided so as to extend downward from the lower edge of the press-insertion portion 92.

Figure 6:
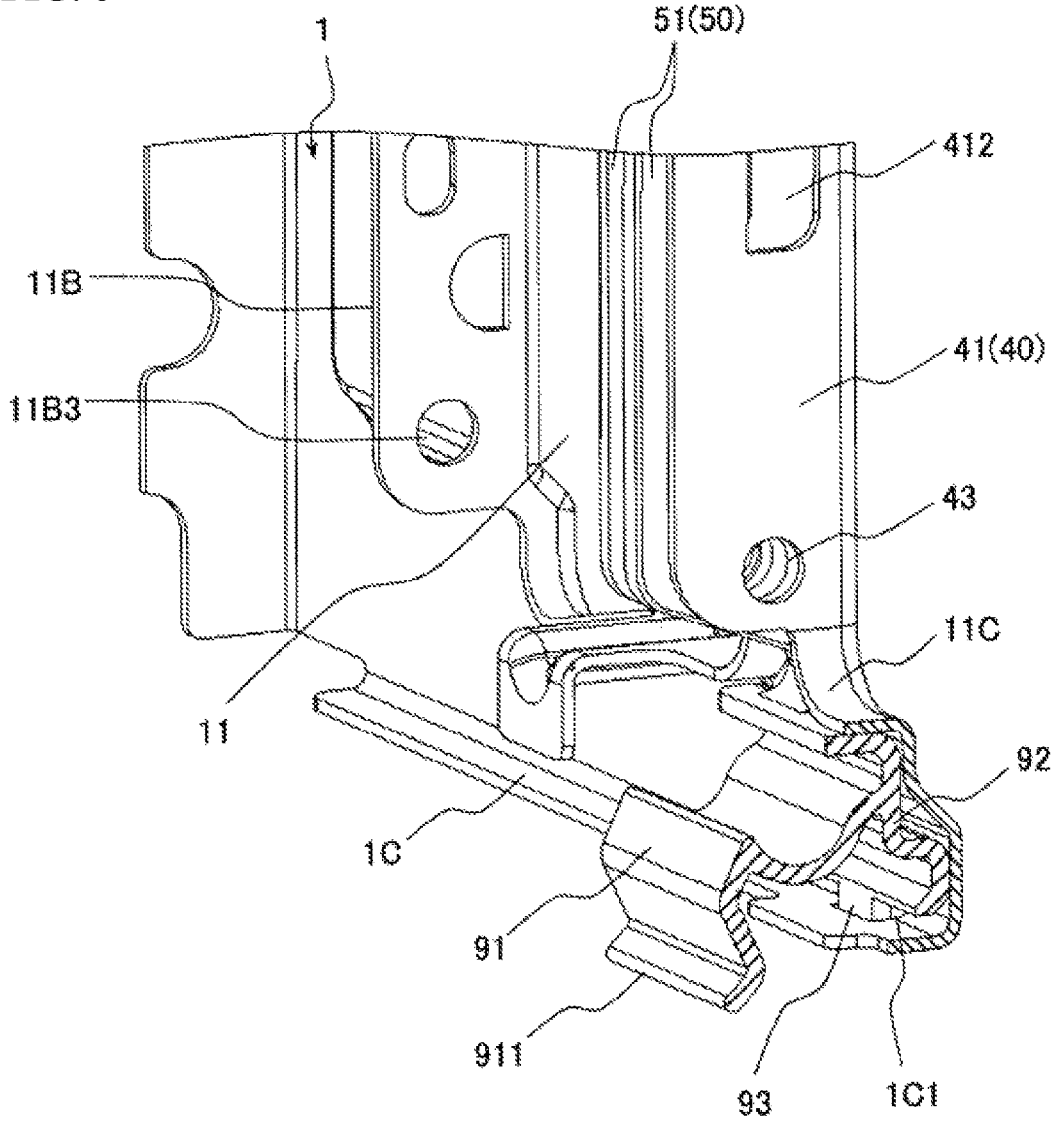
FIG. 6 is a main perspective view illustrating a state where a holder integrated with the bearing member is attached to the base board.

The bearing member 50 is assembled to the bearing holding portion 40 as explalined below. That is, as illustrated in FIG. 6, the holder 9 integrated with the bearing member 50 is first fixed to the base board 1. FIG. 6 illustrates a state where the holder 9 is fixed to the base board 1. However, when the holder 9 is fixed to the base board 1, the holder 9 is disposed close to the base board 1, and the protrusion piece 93 of the holder 9 is inserted into the locking hole 1C1 provided in the lower flange 1C of the base board 1 while the bearing member 50 is inclined so that the upper portion of the bearing member 50 is separated from the base board 1. In a state where the protrusion piece 93 of the holder 9 is inserted into the locking hole 1C1, the upper portion of the press-insertion portion 92 is press-inserted into the lower side of the lower flange 11C of the opening portion 11 of the base board 1. Accordingly, the upper and lower ends of the press-insertion portion 92 are bent so as to be close to each other, and the press-insertion portion 92 is press-inserted between the lower flange 1C of the base board 1 and the lower flange 11C of the opening portion 11, so that the holder 9 is fixed to the base board 1 by locking. At the same time, when the press-insertion portion 92 is press-inserted between the lower flange 1C of the base board 1 and the lower flange 11C of the opening portion 11, the bearing member 50 integrated with the holder 9 is fitted between the locking flanges 41 and 41 of the bearing holding portion 40. In this case, if the plurality of locking protrusions 513 provided in the outer walls of the bearing pieces 51 and 51 of the bearing member 50 contacts the locking flanges 41 and 41 of the bearing holding portion 40, a fitting resistance is generated. However, when the bearing member 50 is press-inserted by a force overcoming the resistance, the bearing pieces 51 and 51 are bent so as to be close to each other, and hence the bearing member 50 can be fitted into the bearing holding portion 40. In this way, when the bearing member 50 is continuously press-inserted while the bearing pieces 51 and 51 are close to each other, the plurality of locking protrusions 513 provided in the bearing pieces 51 and 51 reaches the recessed notches 411 and 411 and the elongated holes 412 and 412 provided in the locking flanges 41 and 41 of the bearing holding portion 40. Accordingly, the bearing pieces 51 and 51 return to the original state and the plurality of locking protrusions 513 engages with the edges of the notches 411 and 411 and the elongated holes 412 and 412, so that the bearing member 50 is fixed to the bearing holding portion 40 by locking.

The flange 11B (see FIG. 4) provided at the right edge of the opening portion 11 is provided with a pair of elongated holes 11B11 and 11B12 which extends in the up and down direction so as to correspond to the elongated holes 511 and 511 and the elongated hole 512 provided in the bearing pieces 51 and 51 of the bearing member 50. Further, the flange 11B is provided with two support shaft holes 11B1 and 11B2 which are provided at the substantial center portion in the up and down direction with a gap therebetween so as to correspond to the shaft hole 54 and the support shaft holes 52 and 53 provided in the bearing pieces 51 and 51, and is provided with a shaft hole 11B3 provided at the lower position. Similarly to two support shaft holes 11B1 and 11B2 of the flange 11B, two support shaft holes 11A1 and 11A2 are provided at the substantial center position in the up and down direction of the flange 11A provided at the left edge (in FIG. 3) of the opening portion 11.

The elongated holes 511 and 511 provided in the bearing pieces 51 and 51 of the bearing member 50 and the elongated hole 11B11 provided in the flange 11B provided at the right edge of the opening portion 11 support an upper link pin 61 (see FIG. 2) of the link mechanism 6 so as to be slidable in the up and down direction, and the elongated holes 512 provided in the bearing pieces 51 and 51 of the bearing member 50 and the elongated hole 11B12 provided in the flange 11B provided at the right edge of the opening portion 11 support a lower link pin 62 (see FIG. 2) of the link mechanism 6 so as to be slidable in the up and down direction. Here, one (the left bearing piece 51 in FIGS. 5A to 5C) of the bearing pieces 51 and 51 of the bearing member 50 is provided with the elongated hole 512, but the other bearing piece 51 is not provided with the elongated hole. However, the other bearing piece 51 is used to prevent the separation of the lower link pin 62. Additionally, the elongated holes 412 and 412 provided in the locking flanges 41 and 41 of the bearing holding portion 40 are provided so as to be much larger than the elongated hole 512 provided in the bearing piece 51, 51 of the bearing member 50. Further, the recessed notches 411 and 411 provided in the locking flanges 41 and 41 of the bearing holding portion 40 are notched so as to be much larger than the elongated holes 511 and 511 provided in the bearing pieces 51 and 51 of the bearing member 50, and do not contact the lower link pin 62 of the upper link pin 61.

Further, the support shaft holes 42 and 42 provided in the locking flanges 41 and 41 of the bearing holding portion 40, the support shaft holes 52 and 52 provided in the bearing pieces 51 and 51 of the bearing member 50, the support shaft hole 11A1 provided in the flange 11A of the opening portion 11 of the base board 1, and the support shaft hole 11B1 provided in the flange 11B support the rotation shaft 30 (see FIG. 2) of the second stopper member 3. Meanwhile, the support shaft holes 43 and 43 provided in the locking flanges 41 and 41, the support shaft holes 53 and 53 provided in the bearing pieces 51 and 51, the support shaft hole 11A2 provided in the flange 11A of the opening portion 11, and the support shaft hole 11B2 provided in the flange 11B support a rotation shaft 20 (see FIG. 2) of the first stopper member 2. Further, the shaft holes 44 and 44 provided in the locking flanges 41 and 41, the shaft holes 54 and 54 provided in the bearing pieces 51 and 51, and the shaft hole 11B3 provided in the flange 11B support a rotation shaft 70 (see FIG. 2) of the rotation stopper 7. Additionally, beveling is performed on the groove edges of the elongated holes 11B11 and 11B12 of the flange 11B, and burring is performed on the support shaft holes 42 and 43 and the shaft hole 44 of the locking flanges 41 and 41, the support shaft holes 11A1 and 11A2 of the flange 11A, and the support shaft holes 11B1 and 11B2 and the shaft hole 11B3 of the flange 11B so as to reduce a friction with respect to the upper link pin 61 and the lower link pin 62 or the rotation shafts 20, 30, and 70.

Figure 7:
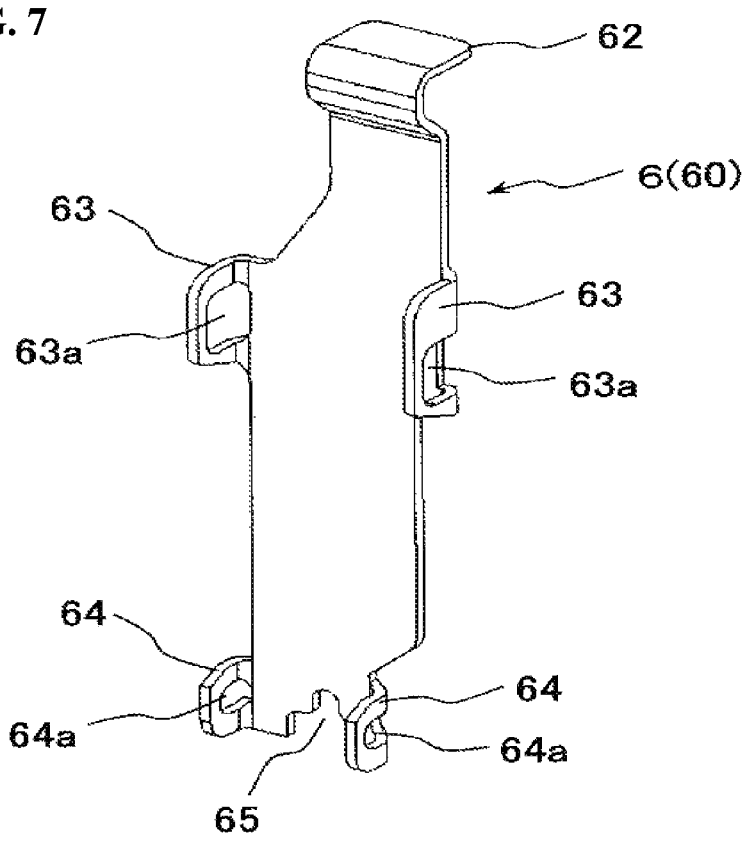
FIG. 7 is a perspective view of a link member in the article ejecting device of FIGS. 1 and 2.

The link mechanism 6 includes a link member 60 that is provided by a steel plate so as to extend in the up and down direction, and is connected to a plunger 51 of the solenoid 5 as the driving unit. The solenoid 5 is fixed to a position closer to one of the left and right sides of the rear surface of the base board 1 by threading. As illustrated in FIG. 7, the upper end of the link member 60 is provided with the connecting portion 62 locked to the engagement hole of the plunger 51 of the solenoid 5. Further, the link member 60 is provided with a pair of left and right upper engagement portions 63 each having an engagement hole 63*a* through which the upper link pin 61 is inserted. The upper engagement portion 63 is used to move the upper link pin 61 in the up and down direction in synchronization with the up/down operation of the link member 60. Further, the lower end of the link member 60 is provided with a pair of left and right lower engagement portions 64 each having an engagement hole 64*a* through which the lower link pin 62 is inserted. The lower engagement portion 64 is used to move the lower link pin 62 in the up and down direction in synchronization with the up/down operation of the link member 60. A notch 65 is provided at the center position of the lower engagement portion 64. The notch 65 is provided as an escape hole used when one side of a return spring 66 (see FIG. 2) as a coil spring engages with the lower link pin 62. The other side (the lower side) of the return spring 66 is locked to the rotation shaft 70 of the rotation stopper 7.

Figure 1:
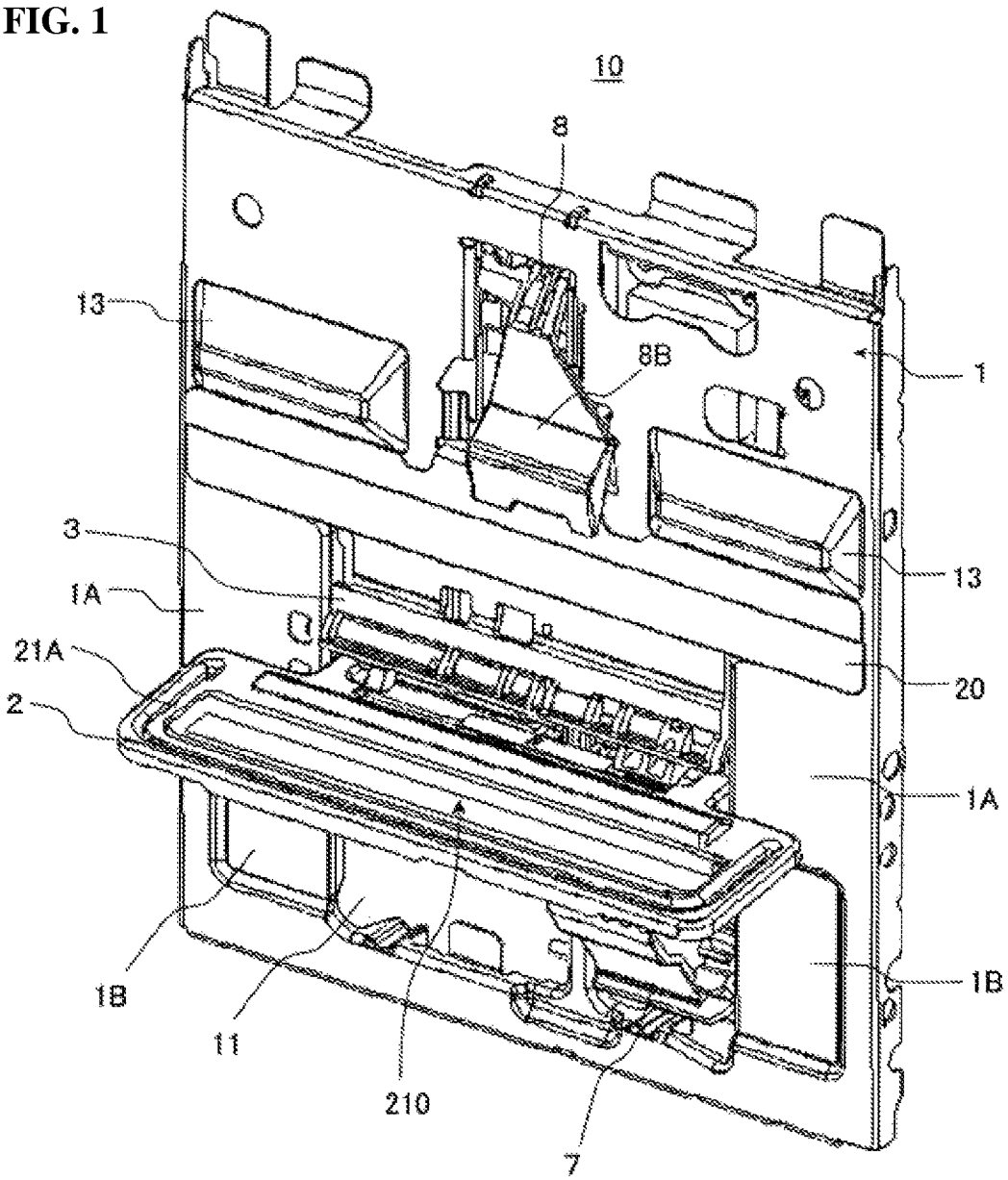
FIG. 1 is a front perspective view of an article ejecting device of an automatic vending machine according to an embodiment of the invention.
Figure 8:
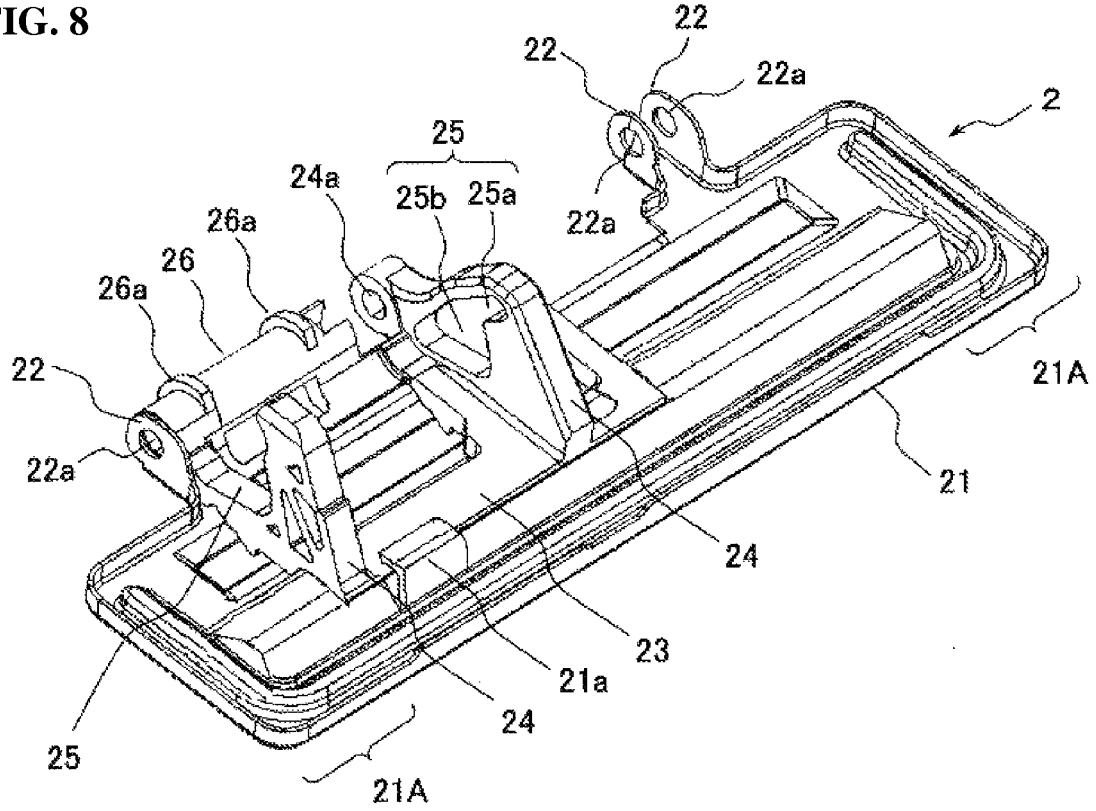
FIG. 8 is a rear perspective view of a first stopper member of the article ejecting device of FIGS. 1 and 2.
Figure 14:
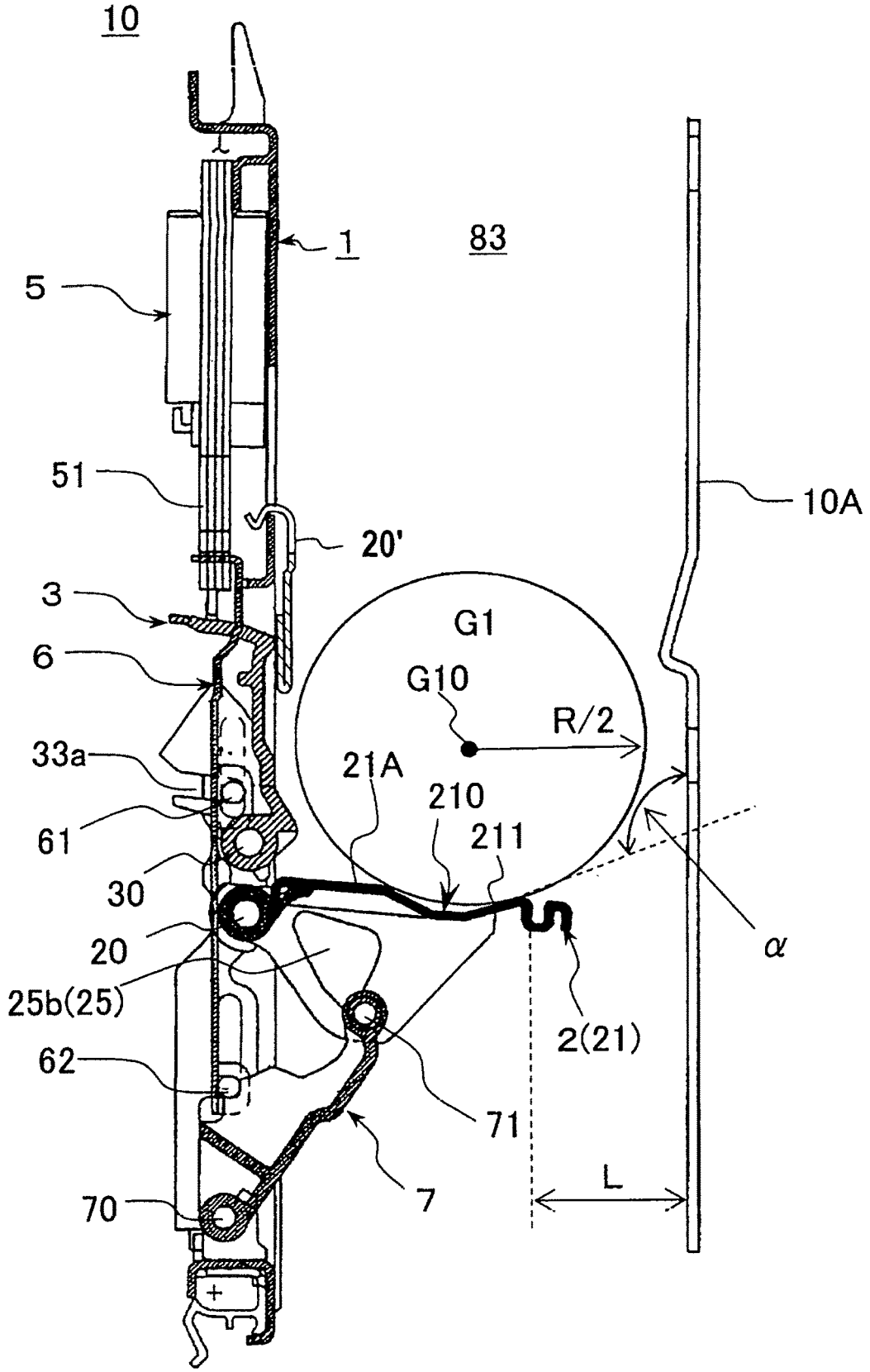
FIG. 14 is a diagram illustrating a state where an article is loaded in the article ejecting device of the automatic vending machine according to the first embodiment of the invention.

As illustrated in FIG. 8, the first stopper member 2 includes a bearing stand 23 which is formed of resin (for example, polyacetal) in a rear surface of a metal plate 21 having a flat plate shape and bent toward the rear surface in the peripheral edge thereof. As illustrated in FIG. 2, the first stopper member 2 is rotatably supported by the rotation shaft 20 while being interposed between the flanges 11A and 11B formed at both left and right edges of the opening portion 11 of the base board 1. The first stopper member 2 rotates about the rotation shaft 20 and is movable between a protruding position in which the first stopper member protrudes from the opening portion 11 of the base board 1 toward the article storage passage 83 (see FIG. 11) and a retractable position in which the first stopper member is retracted from the article storage passage 83 so as to block the opening portion 11. A twist coil spring 20*a* (see FIG. 2) is wound on the rotation shaft 20. The first stopper member 2 is normally urged toward the protruding position by the elastic urging force of the twist coil spring 20*a*, and the front surface (the upper surface) of the metal plate 21 at the protruding position is provided as an article placement surface 21A used to place an article G (see FIG. 11) thereon. Further, as illustrated in FIGS. 1 and 14, the article placement surface 21A of the metal plate 21 is provided with a holding portion 210 as a recess portion. The holding portion 210 is used to hold a vending article in a rolling manner when the article is loaded, and the operation of the holding portion 210 will be described with reference to FIGS. 14 to 15E.

A pair of left and right shaft support portions 22 and 22 each having a shaft insertion hole 22*a* protrudes from the metal plate 21 of the first stopper member 2, and the width of the pair of left and right shaft support portions 22 and 22 is set to be narrower than that of the metal plate 21 (the base board 1). In other words, the metal plate 21 includes the extension portions 21A and 21A which extend to the vicinity of the left and right edges of the base board 1 in relation to the pair of left and right shaft support portions 22 and 22. The extension portions 21A and 21A are stored in the recess portions 1B adjacent to the left and right sides of the opening portion 11 of the base board 1 when the first stopper member 2 is retracted to the retractable position. The shaft insertion hole 22*a* of the shaft support portion 22 is used to insert the rotation shaft 20 therethrough. Additionally, the shaft support portion 22 is provided in parallel to the vicinity of the right shaft support portion 22 for the reinforcement purpose as illustrated in FIG. 8.

The bearing stand 23 is locked to the metal plate 21 by a locking claw 21*a* provided in the metal plate 21. The locking claw 21*a* is provided so that a tongue piece is provided by a recess notch provided in the metal plate 21 and is bent and raised. The bearing stand 23 is provided with a pair of left and right guide protrusions 24, 24, and the guide protrusions 24 and 24 are respectively provided with deformed grooves 25 and 25. The deformed grooves 25 and 25 are used to slide an end of a lock pin 71 of the rotation stopper 7 to be described later thereon and to regulate the operation range of the lock pin 71 so that the first stopper member 2 and the rotation stopper 7 move together through the lock pin 71. That is, each of the deformed grooves 25 and 25 includes a small diameter portion 25*a* which sets the lock position of the lock pin 71 and a large diameter portion 25*b* which sets the operation range other than the lock position of the lock pin 71. Here, this kind of deformed groove 25 is disclosed in Japanese Patent No. 4457543. Further, a shaft support portion 26 of the bearing stand 23 is provided with a shaft hole (not illustrated) used to insert the rotation shaft 20 therethrough while being located so as to be coaxial with the shaft insertion holes 22*a* and 22*a* of the pair of left and right shaft support portions 22 and 22 provided in the metal plate 21. Furthermore, each of the pair of left and right guide protrusions 24 and 24 is also provided with a shaft hole 24*a* used to insert the rotation shaft 20 therethrough. Additionally, the pair of guide protrusion portions 26*a* and 26*a* provided in the outer periphery of the shaft support portion 26 is provided so as to interpose the link member 60 therebetween, and is used to prevent the operation of the link member 60 in the up and down direction from being deviated in the left and right direction. Additionally, the metal plate 21 and the bearing stand 23 are integrated in a manner such that the bearing stand 23 is locked to the metal plate 21 by the locking claw 21*a* provided in the metal plate 21 and the rotation shaft 20 is inserted through the shaft hole (not illustrated) provided in the shaft support portion 26 of the bearing stand 23 and the shaft insertion hole 22*a* provided in the pair of left and right shaft support portions 22 and 22 of the metal plate 21.

As illustrated in FIG. 2, the rotation stopper 7 is interposed between the bearing portion 4 and the flange 11B of the opening portion 11 and is rotatably supported by the rotation shaft 70. The rotation stopper 7 rotates about the rotation shaft 70 and is provided so as to be movable between a protruding position in which the rotation stopper protrudes from the opening portion 11 of the base board 1 toward the article storage passage 83 and a retractable position in which the rotation stopper is retracted from the article storage passage 83 so as to block the opening portion 11. Although not illustrated in the drawings, a twist coil spring is wound on the rotation shaft 70. The rotation stopper 7 is normally urged toward the protruding position by the elastic urging force of the twist coil spring. The rotation stopper 7 includes the lock pin 71 (see FIGS. 11 to 13) which is provided at the front end of the rotation stopper protruding toward the inside of the article storage passage 83 and extends left and right at the front end thereof. Both ends of the lock pin 71 engage with the deformed grooves 25 of the pair of left and right guide protrusions 24 and 24 of the bearing stand 23 of the first stopper member 2.

Figure 9:
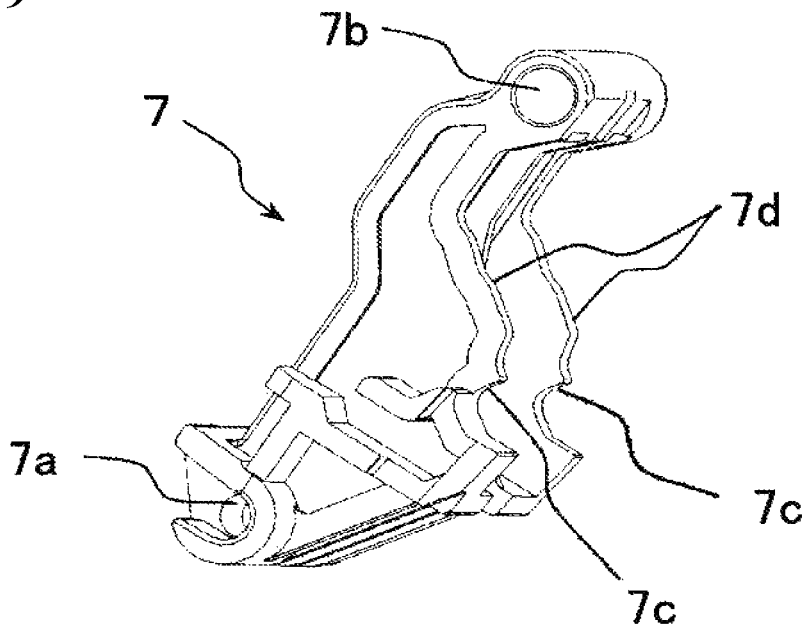
FIG. 9 is a perspective view of a rotation stopper of the article ejecting device of FIGS. 1 and 2.

As illustrated in FIG. 9, the rotation stopper 7 includes pin insertion holes 7*a* and 7*b*. The pin insertion holes 7*a* and 7*b* are used to insert the lock pin 71 and the rotation shaft 70 therethrough. The lock groove 7*c* is used to lock the rotation of the rotation stopper 7 while engaging with the lower link pin 62. Further, an inclined slide surface 7*d* of the rotation stopper 7 is provided so that the lower link pin 62 slides thereon during the rotation of the rotation stopper 7.

The rotation stopper 7 is locked to the protruding position while the lower link pin 62 engages with the lock groove 7*c*. In the lock state, both ends of the lock pin 71 provided at the front end of the rotation stopper 7 engage with the small diameter portions 25*a* of the deformed grooves 25 provided in the pair of left and right guide protrusions 24 and 24 of the first stopper member 2 so that the first stopper member 2 is locked to the protruding position (the vending standby position) in which the rotation stopper protrudes toward the article storage passage 83.

As illustrated in FIG. 2, the second stopper member 3 is interposed between the flanges 11A and 11B provided in the left and right edges of the opening portion 11 of the base board 1, and is rotatably supported by the rotation shaft 30. The second stopper member 3 rotates about the rotation shaft 30, and is movable between a protruding position in which the second stopper member protrudes from the opening portion 11 of the base board 1 toward the inside of the article storage passage 83 and a retractable position in which the second stopper member is retracted from the article storage passage 83 so as to block the opening portion 11. Although not illustrated in the drawings, a twist coil spring is wound on the rotation shaft 30. The second stopper member 3 is normally urged toward the retractable position by the elastic urging force of the twist coil spring.

Figure 10:
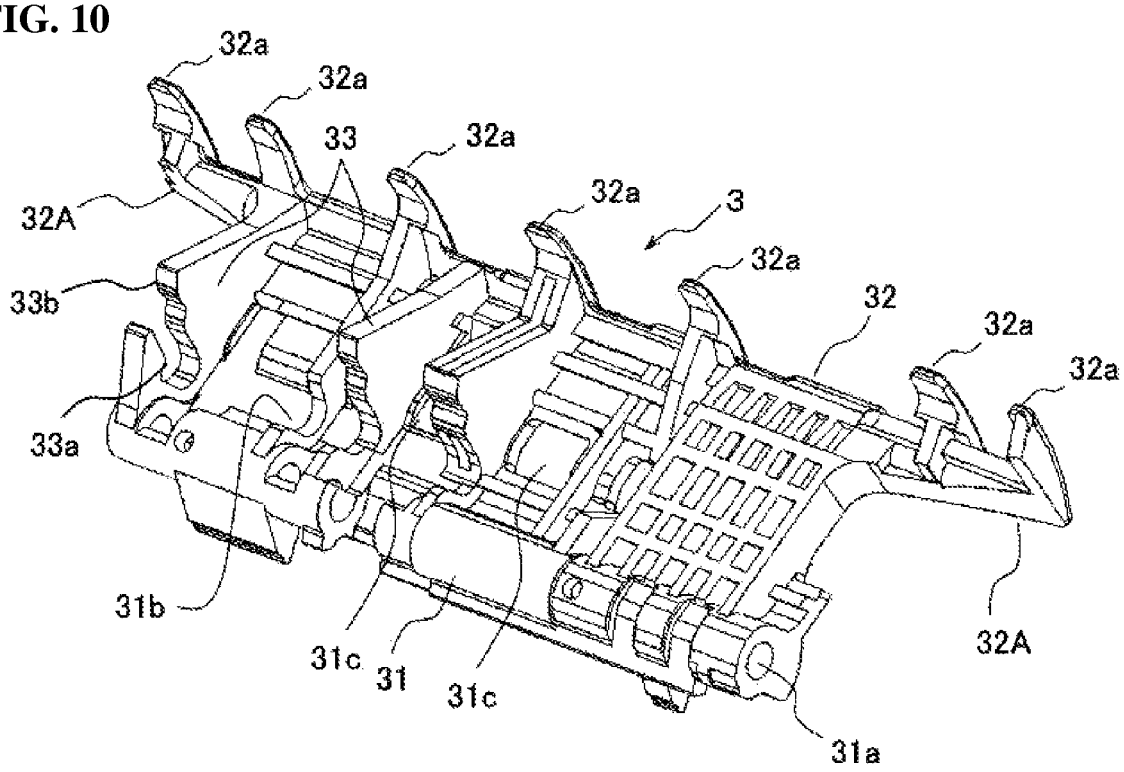
FIG. 10 is a rear perspective view of a second stopper member of the article ejecting device of FIGS. 1 and 2.

As illustrated in FIG. 10, the second stopper member 3 is formed of synthetic resin (for example, polyacetal). Here, a shaft support portion 31 including a pin insertion hole 31*a*, an article holding portion 32 including seven tongue pieces 32*a*, and two stopper walls 33 are integrally molded with one another. The pin insertion hole 31*a* is used to insert the rotation shaft 30 therethrough. Further, the tongue piece 32*a* of the holding portion 32 is provided so as to engage without any cushioning with the tongue piece 32*a* of the second stopper member 3 of one article ejecting device when two article ejecting devices having the same configuration are disposed back to back. Accordingly, the tongue piece is used to fill a gap between the holding portion 32 and the base board 1 when the second stopper member 3 protrudes toward the article storage passage 83. Then, the holding portion 32 is provided so as to be larger than the horizontal width of the shaft support portion 31 including the pin insertion hole 31*a*, and is provided with extension portions 32A and 32A extending left and right with respect to the shaft support portion 31. When the second stopper member 3 is retracted to the retractable position, the extension portions 32A and 32A are retracted to the retractable position while passing by the extension portions 11*a* and 11*a* provided in the upper area of the opening portion 11 of the base board 1. Additionally, the width of the holding portion 32 is equal to the dimension (the width) between the shaft support portions 22 and 22 of the first stopper member 2.

Further, the upper link pin 61 is slidable on a recessed slide groove 33*a* provided in a stopper wall 33, and the upper link pin 61 is received at the retractable position of the second stopper member 3. A stopper surface 33*b* of the stopper wall 33 contacts the upper link pin 61 when the second stopper member 3 protrudes toward the article storage passage 83, and receives an article load applied to the second stopper member 3 so as to lock the second stopper member 3 at the protruding position. Further, a relief groove 31*b* provided in the reinforcement material in the periphery of the stopper wall 33 is provided so as not to disturb an operation in which the upper link pin 61 enters the slide groove 33*a* of the second stopper member 3. In addition, an escape hole 31*c* is used for the case where the article ejecting devices 10 having the same configuration are disposed in back to back and each second stopper member 3 is retracted to the retractable position. Here, the front ends of the reinforcement member and the stopper wall 33 of the other second stopper member 3 escape therethrough. As a result, an increase in thickness of the entire article ejecting device 10 is prevented.

As illustrated in FIGS. 1 and 2, the sellout detection switch (the sellout detector) 8 includes a micro switch 8A and an article detection lever 8B protruding toward the article storage passage 83. The sellout detection switch 8 has a structure in which the micro switch 8A and the article detection lever 8B are assembled to a frame-shaped attachment stand 8C formed of synthetic resin (for example, polyacetal). The article detection lever 8B is rotatably journaled to the attachment stand 8C and is urged toward the article storage passage 83 by a twist coil spring 8D. The spring force of the twist coil spring 8D urging the article detection lever 8B toward the article storage passage 83 is set to a force in which the article detection lever 8B is retracted along the flat surface of the base board 1 so as to allow the passage of the article, and the article detection lever 8B protrudes toward the article storage passage 83 after the passage of the article when the article falling through the article storage passage 83 contacts the article detection lever 8B protruding toward the article storage passage 83. Here, as illustrated in FIGS. 1 and 2, the article detection lever 8B is disposed in the upper area of the second stopper member 3. This arrangement is set to prevent a problem in which the article detection lever 8B protruding toward the article storage passage 83 interferes with the second stopper member 3 moving between the protruding position and the retractable position to thereby give a bad influence on the second stopper member 3. For this reason, the article detection lever 8B is configured to detect the existence of the next vending article stacked on the vending article. When the next vending article exists, the article detection lever is pressed by the next vending article so as to be retracted along the flat surface of the base board 1. Meanwhile, when the next vending article does not exist (the sold-out state), the article detection lever is rotated by the twist coil spring 8D so as to protrude toward the article storage passage 83 and to operate the micro switch 8A. In other words, the article detection lever 8B is arranged to detect whether any article remains in the article storage passage 83.

As illustrated in FIG. 1, the closing plate 20' is located above the second stopper member 3, and is drooped so as to cover the second stopper member 3 returned to the retractable position from the article storage passage 83. As in the related art, the closing plate 20' moves in synchronization with the movement of the second stopper member 3 toward the protruding position so as to advance toward the article storage passage 83, and is interposed between the next vending article and the article holding portion 32 of the second stopper member 3 so as to fill a gap between the base board 1 and the article holding portion 32 of the second stopper member 3.

Figure 12:
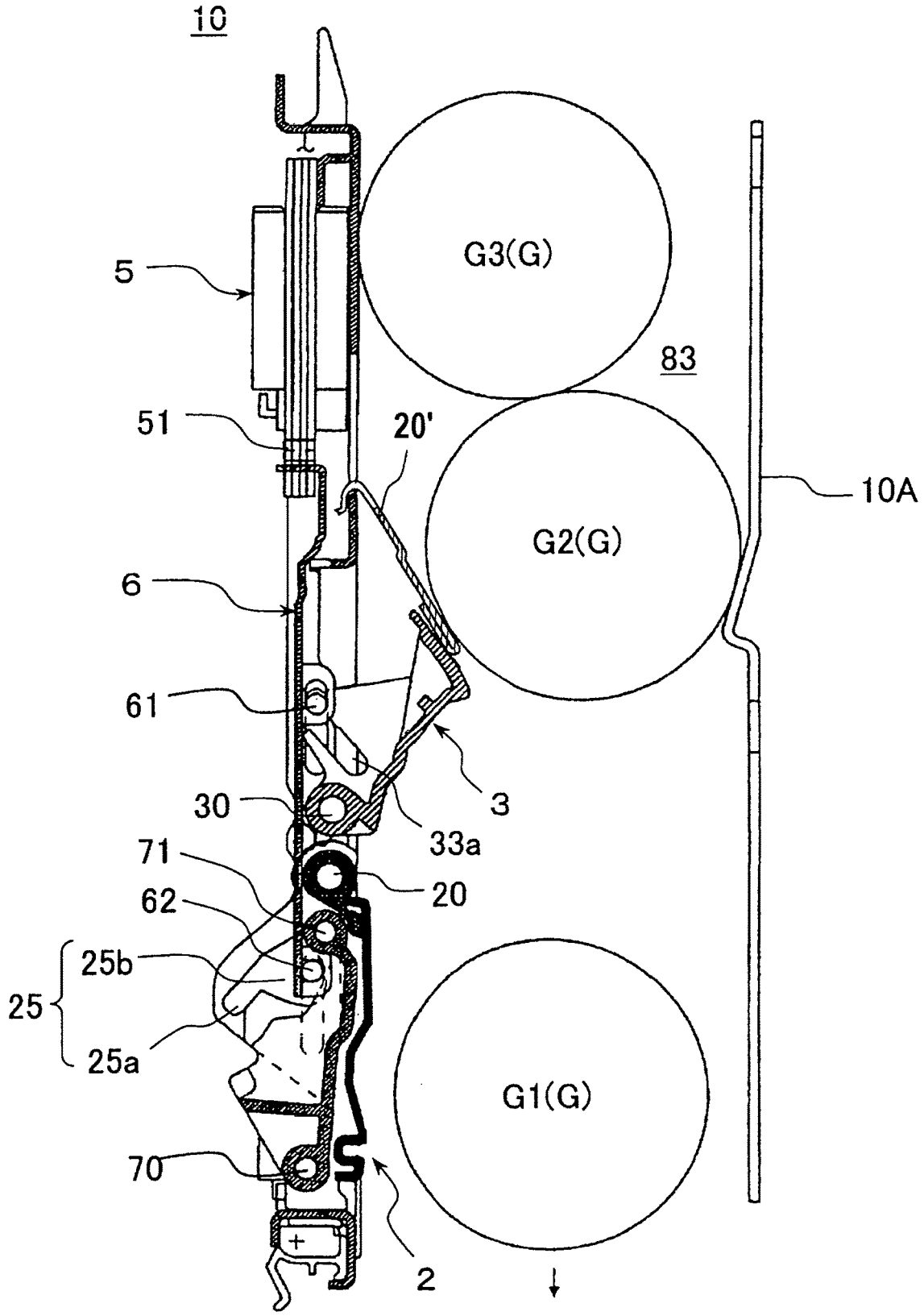
FIG. 12 is a diagram illustrating an operation when an article is ejected in the article ejecting device of the automatic vending machine according to the invention.
Figure 13:
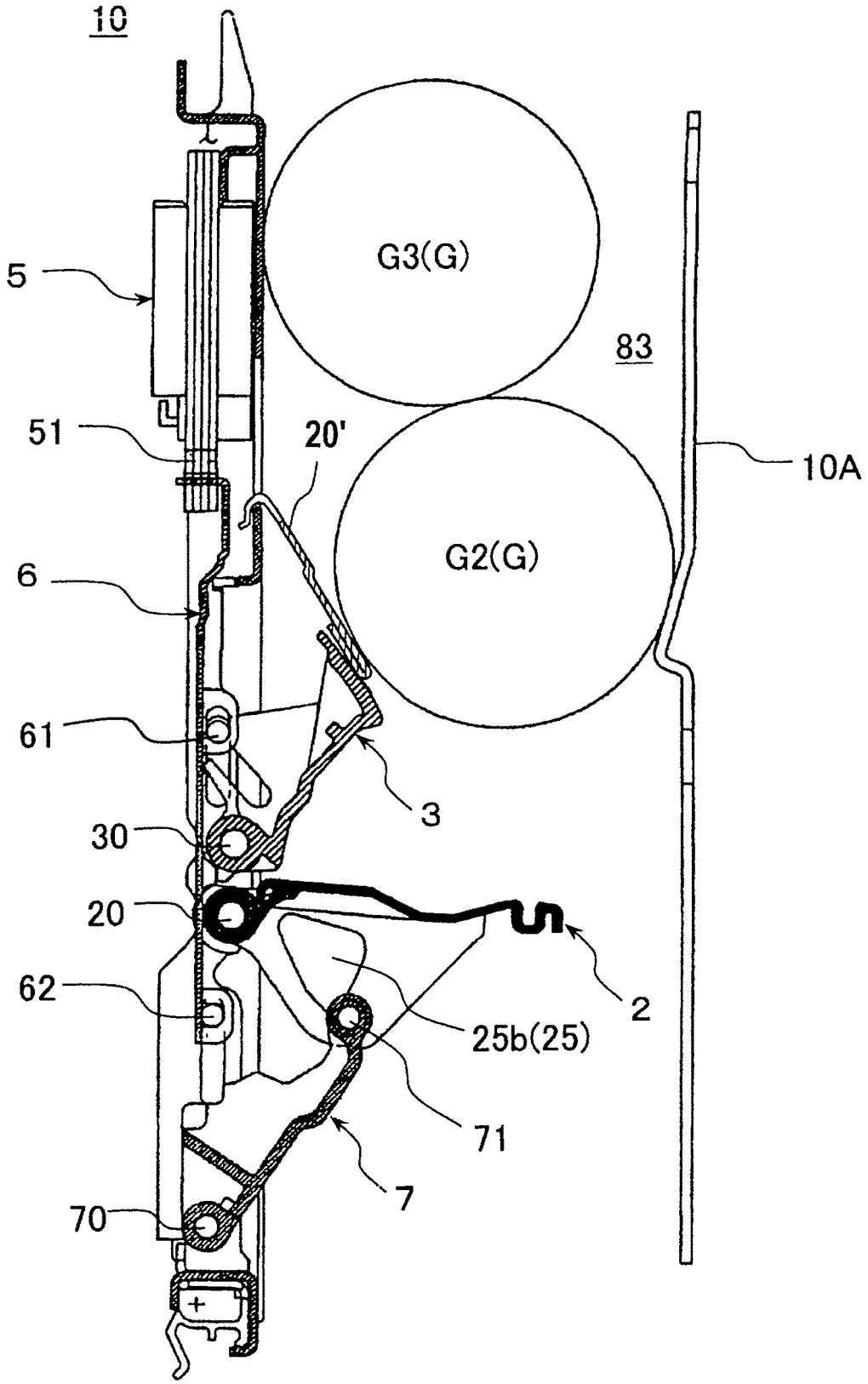
FIG. 13 is a diagram illustrating an operation after an article is ejected in the article ejecting device of the automatic vending machine according to the invention.

Next, the operation of the article ejecting device of the automatic vending machine according to the embodiment of the invention will be described with reference to FIGS. 11 to 13. Additionally, FIGS. 11 to 13 illustrate a schematic configuration in order to easily comprehend the operation of the article ejecting device.

Figure 11:
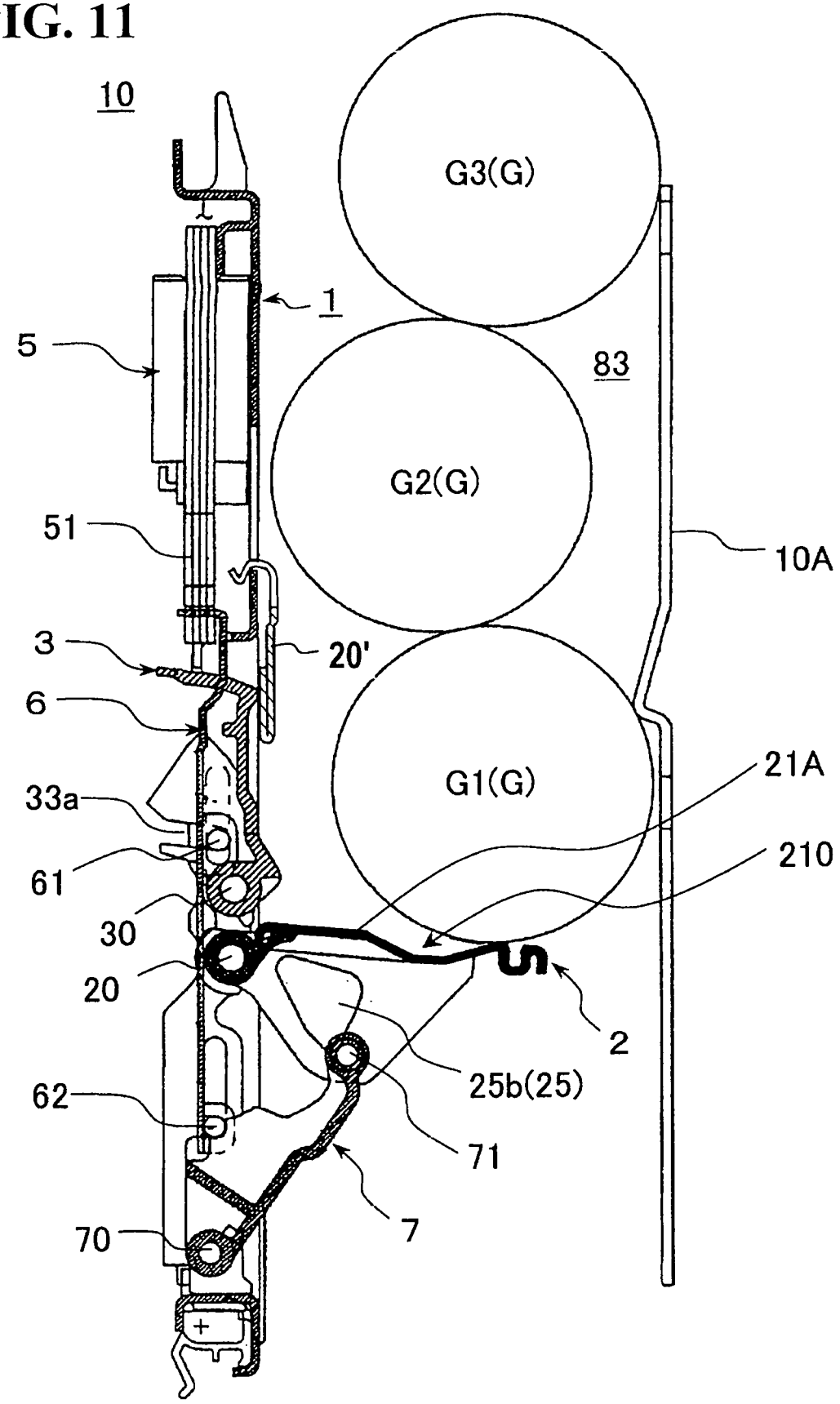
FIG. 11 is a diagram illustrating an operation in a vending standby state of the article ejecting device of the automatic vending machine according to the invention.

The vending standby state illustrated in FIG. 11 indicates a state wherein the solenoid 5 is not energized and the link member 60 is urged downward by the return spring 66 (see FIG. 2). That is, the upper link pin 61 moves downward along the elongated hole 511 (see FIGS. 5A to 5C) provided in the bearing member 50 of the bearing portion 4, and the lower link pin 62 moves downward along the elongated hole 512 provided in the bearing member 50 of the bearing portion 4. In the vending standby state, the first stopper member 2 is located at the protruding position by the elastic urging force of the twist coil spring 20*a* (see FIG. 2). Further, the first stopper member 2 receives the load of the article G while the holding surface thereof contacts a vending article G1. Further, in the vending standby state, the rotation stopper 7 is located at the protruding position by the elastic urging force of the twist coil spring (not illustrated). Furthermore, the rotation stopper 7 receives the load of the article G applied to the first stopper member 2 in a manner such that the lock pin 71 engages the small diameter portion 25*a* (see FIG. 8) of the deformed groove 25 of the first stopper member 2. Also, the rotation stopper 7 is held at the protruding position in a manner such that the lower link pin 62 engages the lock groove 7*c* (see FIG. 9). Accordingly, the rotation stopper 7 holds the first stopper member 2 at the protruding position so as to suppress the movement of the first stopper member 2 toward the retractable position. Further, in the vending standby state, the second stopper member 3 is returned to the retractable position by the elastic urging force of the twist coil spring (not illustrated). In this case, the extension portions 32A and 32A of the second stopper member 3 return to the retractable position while passing the extension portions 11*a* and 11*a* provided in the upper area of the opening portion 11 of the base board 1. Further, the closing plate 20' is drooped along the base board 1.

When the solenoid 5 is energized by a vending instruction from the vending standby state illustrated in FIG. 11, the solenoid 5 suctions the plunger 51 against the elastic urging force of the return spring 66 and moves the link member 60 upward. Then, the lower link pin 62 of the link member 60 moves upward so as to release the engagement with the lock groove 7*c* of the rotation stopper 7. When the lock is released, the rotation stopper 7 rotates about the rotation shaft 70 toward the retractable position by the article load. Accordingly, the lock pin 71 is also separated from the small diameter portion 25*a* of the deformed groove 25 so as to release the lock state of the first stopper member 2, and hence the first stopper member 2 rotates toward the retractable position by the article load.

At the same time, the second stopper member 3 protrudes from the retractable position toward the protruding position by the upper link pin 61 of the upward moving link member 60. That is, when the link member 60 moves upward from the vending standby state, the upper link pin 61 engaging with the slide groove 33*a* of the second stopper member 3 moves upward. Then, the second stopper member 3 moves about the rotation shaft 30 toward the protruding position against the elastic urging force of the twist coil spring. When the link member 60 moves to the upper-limit position, the upper link pin 61 engages the stopper surface 33*b* of the second stopper member 3 so as to lock the second stopper member 3 at the protruding position. While the second stopper member 3 moves from the retractable position to the protruding position, the front end (the article holding portion 32) of the second stopper member 3 contacts the rear surface (the surface opposite to the surface exposed to the article storage passage 83) of the closing plate 20' so as to press the closing plate 20' toward the article storage passage 83. That is, the closing plate 20' is pressed from the retractable position of the second stopper member 3 toward the article storage passage 83 in synchronization with the movement toward the protruding position. The article holding portion 32 of the second stopper member 3 reaching the protruding position locks the next vending article G2 through the closing plate 20' blocking a gap between the base board 1 and the article holding portion 32, and holds the next vending article G2 between the article holding portion and the outlet adjustment member 10A. As a result, the vending article G1 located at the lowest position is ejected while slipping through the first stopper member 2 (see FIG. 12).

When the vending article G1 is ejected so that the first stopper member 2 does not receive the article load, the first stopper member 2 returns to the protruding position (the vending standby position) by the urging force of the twist coil spring 20*a* (see FIG. 13). At the same time, the rotation stopper 7 also returns to the protruding position by the elastic urging force of the twist coil spring. In this case, the lock pin 71 provided at the front end of the rotation stopper 7 slides on the wall surface of the large diameter portion 25*b* of the deformed groove 25 in the first stopper member 2 and reaches the small diameter portion 25*a*. Accordingly, the first stopper member 2 is locked at the vending standby position.

Then, when the solenoid 5 is not energized, the link member 60 moves downward by the urging force of the return spring 66, the lock state of the second stopper member 3 caused by the upper link pin 61 is released, and hence the second stopper member 3 returns to the standby position by the urging force of the twist coil spring. Further, when the link member 60 moves down to the lower limit position, the lower link pin 62 engages the lock groove 7*c* of the rotation stopper 7 so as to hold the first stopper member 2 at the vending standby position (see FIG. 11). When one article G is left in the article storage passage 83 as the article G is sold, the article detection lever 8B (see FIG. 1) of the sellout detection switch 8 detects whether the article in the article storage passage 83 is sold out.

Here, the extension portions 11*a* and 11*a* which extend left and right are provided at the upper area of the opening portion 11 provided in the base board 1 of the article ejecting device 10. This is because the second stopper member 3 movable between the protruding position in which the stopper member protrudes toward the article storage passage 83 so as to hold the next vending article G2 and the retractable position in which the stopper member is retracted from the article storage passage 83 includes the plurality of tongue pieces 32*a* in the article holding portion 32 including the extension portions 32A and 32A and the extension portions 32A and 32A and the tongue pieces 32*a* provided in the extension portions 32A and 32A are retracted to the retractable position. For this reason, since the opening portion 11 having the extension portions 11*a* and 11*a* provided in the upper area of the opening portion 11 so as to extend left and right is smaller than the opening portion of the base board disclosed in Japanese Patent Nos. 3855573 and 3781548 and the closing portions 1A and 1A having at least widths corresponding to the extension portions 21A and 21A of the first stopper member 2 are provided between the opening portion 11 and the left and right edges of the base board 1, the mechanical strength can be remarkably improved when the thickness of the base board 1 is uniform, and hence the base board 1 can be decreased in thickness.

Further, such an article ejecting device 10 of the automatic vending machine is provided as two kinds of article ejecting devices in response to the kind (generally, two kinds of articles including a comparatively short article and a comparatively long article) of the article storage rack 108 as described in the background art. However, when the shaft support portions 22 and 22 of the first stopper members 2 and the shaft support portion 31 of the second stopper members 3 of two kinds of article ejecting devices are made to have the same width, the rotation shaft 20 of the first stopper member 2 and the rotation shaft 30 of the second stopper member 3 can be commonly used in two kinds of article ejecting devices. In this case, the second stopper member 3 including the extension portions 32A and 32A is employed in the article ejecting device for a comparatively long article. Then, when both ends of the tongue pieces 32*a* and 32*a* located at the second positions in the extension portions 32A and 32A from the outside thereof are cut, the second stopper member can be used as the second stopper member of the article ejecting device for a comparatively short article.

Figure 15A:
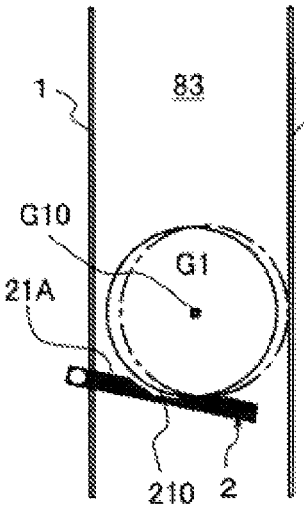
Figure 15B:
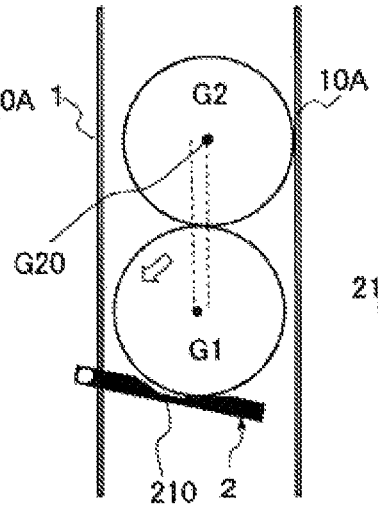
Figure 15C:
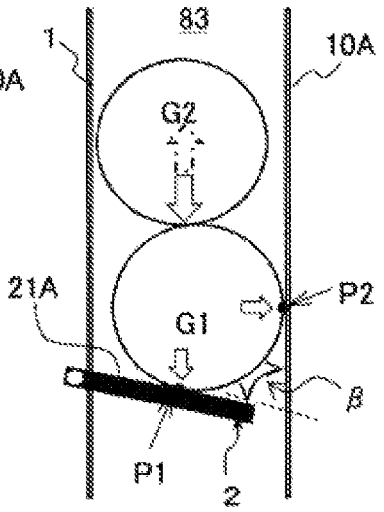
Figure 15D:
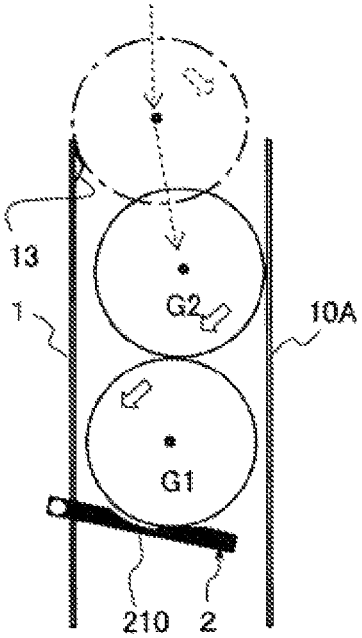
Figure 15E:
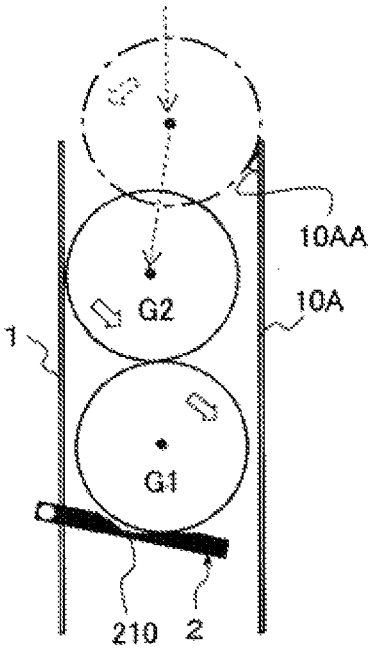

Incidentally, as illustrated in FIG. 1, a holding portion 210 as a recess portion is provided in the article placement surface 21A of the metal plate 21 forming the first stopper member 2 of the article ejecting device 10. The holding portion 210 will be described with reference to FIGS. 14 to 15E. FIG. 14 is a diagram illustrating a state where an article is loaded in the article ejecting device of the automatic vending machine according to the embodiment of the invention. FIGS. 15A to 15E are schematic diagrams of FIG. 14, where FIG. 15A is a diagram illustrating a vending article loading operation, FIG. 15B is a diagram illustrating a next vending article loading operation, FIGS. 15C and 15D are diagrams illustrating an operation of displacing a next vending article falling direction, and FIG. 15E is a diagram illustrating an article ejecting device of the related art as a comparative example.

In FIG. 14, the base board 1 of the article ejecting device 10 forms one passage forming member of the article storage passage 83 in the area of the article ejecting device 10, and the outlet adjustment member 10A facing the article ejecting device 10 forms the other passage forming member of the article storage passage 83. The holding portion 210 formed as an inverse trapezoidal recess portion in the article placement surface 21A of the metal plate 21 forming the first stopper member 2 of the article ejecting device 10 receives the first loaded article after the installation of the automatic vending machine or the first loaded article (the vending article G1 as the first vending target) loaded when the article is replaced by the article in the article storage rack 108 (see FIG. 18) (when the article left in the article storage passage 83 is sent out by the operation of the article ejecting device 10 and a new article is loaded) and holds the vending article G1 without any contact with the base board 1 of the article ejecting device 10 and the outlet adjustment member 10A disposed to face the article ejecting device 10. In this case, a holding surface 211 of the inverse trapezoidal holding portion 210 near the outlet adjustment member 10A is inclined upward with respect to the horizontal plane, and is provided so that an angle $\alpha$ intersecting the outlet adjustment member 10A becomes an obtuse angle. Further, the edge of the inverse trapezoidal recess portion of the holding portion 210 near the outlet adjustment member 10A is formed so that the horizontal distance L to the outlet adjustment member 10A satisfies a relation of $L<R/2$ on the assumption that the diameter of the vending article G1 is indicated by R and the gravity center G10 of the vending article G1 is located at the center of the diameter. Accordingly, even when the loaded vending article G1 is landed on the article placement surface 21A of the first stopper member 2 near the outlet adjustment member 10A so as to contact the outlet adjustment member 10A (which is indicated by the one-dotted chain line in FIG. 15A), the gravity center G10 of the vending article G1 is located at the side (the side of the base board 1) opposite to the outlet adjustment member 10A in relation to the edge of the inverse trapezoidal recess portion of the holding portion 210 near the outlet adjustment member 10A, and hence the vending article G1 rolls while being separated from the outlet adjustment member 10A so as to be received and held in the holding portion 210. When the loaded vending article G1 is landed on the article placement surface 21A of the first stopper member 2 near the base board 1 so as to contact the base board 1, the first stopper member 2 protrudes toward the article storage passage 83 so as to hold the vending article G1. In this state, since the first stopper member is inclined downward in relation to the horizontal line, the vending article G1 rolls while being separated from the base board 1 so as to be received and held in the holding portion 210. In this case, when the vending article G1 rolls over the holding portion 210 until contacting the outlet adjustment member 10A, the vending article rolls while being separated from the outlet adjustment member 10A so as to be received and held in the holding portion 210 as described above. Then, the vending article G1 is held in a rolling manner in a state where the vending article is held in the holding portion 210 of the first stopper member 2, and hence the vending article rolls when an external force is given. Additionally, the rebounding of the vending article generated when the vending article G1 is landed on the article placement surface 21A of the first stopper member 2 is suppressed by the article detection lever 8B protruding toward the article storage passage 83 of the sellout detection switch 8.

Subsequently, when the article (the next vending article G2) as a second vending target is loaded as illustrated in FIG. 15B, the next vending article G2 falls onto the vending article G1. In this case, when the gravity center G20 of the next vending article G2 falling onto the vending article G1 is deviated from the extension line of the gravity center G10 of the vending article G1, the vending article G1 rolls (as indicated by the white arrow of FIG. 15B) so as to escape (separate) from the next vending article G2 so that the impact generated between the vending article and the next vending article G2 is distributed. Accordingly, the reaction force to the next vending article G2 is suppressed, and hence the rebounding of the next vending article G2 is prevented. That is, it is possible to prevent a problem in which the next vending article G2 stands up due to the impact generated when the next vending article G2 collides with the vending article G1. Thus, the articles can be reliably stored in the article storage passage 83 while being stably laid sideways even when the article is first loaded in the automatic vending machine or the article is loaded for the replacement of the article in the article storage rack 108. Here, as obvious from the comparison with the article ejecting device of the related art as a comparative example illustrated in FIG. 15E, in the comparative example, the vending article G1 is supported while contacting the article placement surface 21A of the first stopper member 2 and the outlet adjustment member 10A at two points P1 and P2, and hence the vending article cannot move. For this reason, the impact generated when the next vending article G2 falls onto the vending article G1 is not distributed, and is applied as a reaction force to the next vending article G2 so that the next vending article is bounded largely. Regarding this point, in the invention, the vending article G1 rolls so as to escape (separate) from the next vending article G2 when the next vending article G2 falls onto the vending article G1 so that the impact generated between the vending article and the next vending article G2 is distributed, and hence the reaction force to the next vending article G2 is suppressed. Thus, the rebounding of the next vending article G2 is prevented.

Additionally, when the next vending article G2 is stacked on the vending article G1, the vending article G1 contacts the base board 1 of the article ejecting device 10 or the outlet adjustment member 10A due to the load of the next vending article G2, so that the vending article cannot move. However, since the space of the article storage passage 83 provided in a linear shape in the area of the article ejecting device 10 is not enough as a space necessary for the standing of the third loaded article, the standing of the third loaded article is suppressed by the passage forming member (the rail segment) defining the meandering article storage passage above of the area of the article ejecting device 10.

Here, when the gravity center G20 of the next vending article G2 falling onto the vending article G1 is located on the extension line of the gravity center G10 of the vending article G1, there is a concern that the vending article G1 may not move (roll) and the next vending article G2 may be rebounded. In order to prevent such a problem, the guide protrusion 13 (see FIG. 1) or a protrusion 10AA (see FIG. 15D) protruding toward the article storage passage 83 is provided at an appropriate position (the upper position of the vending article G1 held by the first stopper member 2) of the base board 1 or the outlet adjustment member 10A so that the protrusion deviates the position of the falling next vending article G2. Accordingly, the next vending article contacts the guide protrusion 13 or the protrusion 10AA so that the gravity center G20 of the next vending article G2 is not located at the position on the extension line of the gravity center G10 of the vending article G1. Here, FIGS. 15C and 15D are schematic diagrams illustrating the guide protrusion 13 or the protrusion 10AA when the next vending article G2 falls in the article storage passage 83. Additionally, in FIGS. 15C and 15D, the gravity centers of the vending article G1 and the next vending article G2 are respectively indicated by black circles. As understood from FIGS. 15C and 15D, when the next vending article G2 contacts the guide protrusion 13 or the protrusion 10AA (as indicated by the one-dotted chain line), the next vending article G2 moves in a direction opposite to the guide protrusion 13 or the protrusion 10AA, and hence the gravity center of the next vending article G2 is deviated from the extension line of the gravity center of the vending article G1. Further, when the next vending article G2 contacts the guide protrusion 13 or the protrusion 10AA, a rotation (indicated by the white arrow) is given to the next vending article G2, and the rolling (indicated by the white arrow) of the vending article G1 is also promoted by the rotation of the next vending article G2.

Figure 16:
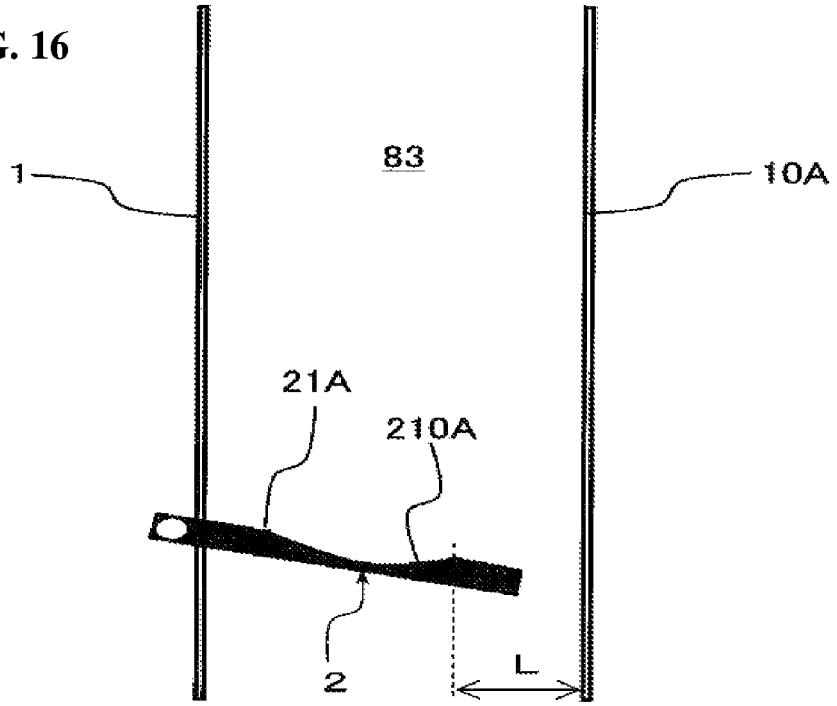
FIG. 16 is a schematic diagram of an article ejecting device of an automatic vending machine according to a modified example of the invention.
Figure 17:
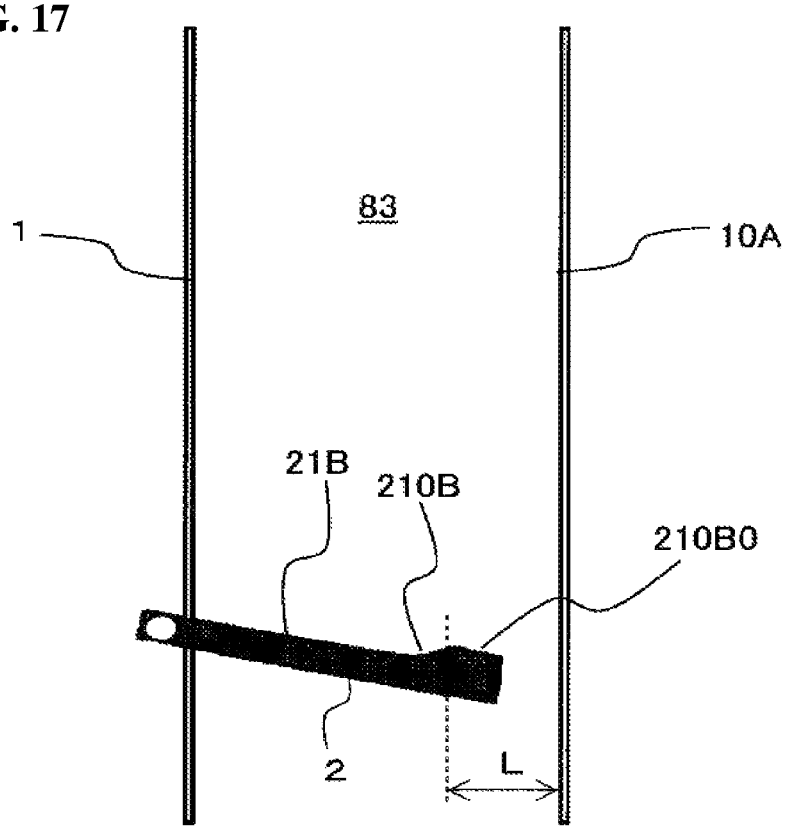
FIG. 17 is a schematic diagram of an article ejecting device of an automatic vending machine according to another modified example of the invention.

Next, FIGS. 16 and 17 respectively indicate the modified examples of the holding portion 210 provided in the first stopper member 2 illustrated in FIG. 14. The holding portion 210 provided in the first stopper member 2 illustrated in FIG. 14 is the inverse trapezoidal recess portion. However, in the modified example illustrated in FIG. 16, a holding portion 210A is provided as a circular-arc recess portion. Then, in the modified example illustrated in FIG. 17, a holding portion 210B is provided as a recess portion obtained by a protrusion portion 210BO protruding upward from a front end of a first stopper member 2B. In this case, in the modified example illustrated in FIG. 16, the circular-arc shape of the holding portion 210A as the circular-arc recess portion is set to be larger than the circular-arc shape of the vending article G1, and hence the vending article G1 can easily roll. Further, in the circular-arc edge of the holding portion 210A near the outlet adjustment member 10A in the modified example illustrated in FIG. 16, as illustrated in FIG. 14 the horizontal distance L to the outlet adjustment member 10A satisfies a relation of $L<R/2$ on the assumption that the diameter of the vending article G1 is indicated by R and the gravity center G10 of the vending article G1 is located at the center of the diameter. Meanwhile, even in the edge of the protrusion portion 210BO forming the holding portion 210B in the modified example illustrated in FIG. 17, as illustrated in FIG. 14, the horizontal distance L to the outlet adjustment member 10A satisfies a relation of $L<R/2$ on the assumption that the diameter of the vending article G1 is indicated by R and the gravity center G10 of the vending article G1 is located at the center of the diameter.

In the modified examples illustrated in FIGS. 16 and 17, even when the loaded vending article G1 is landed on the article placement surface 21A of the first stopper member 2 near the outlet adjustment member 10A so as to contact the outlet adjustment member 10A, the gravity center G10 of the vending article G1 (see FIG. 14) is located at the side (the side of the base board 1) opposite to the outlet adjustment member 10A in relation to the edges of the holding portions 210A and 210B near the outlet adjustment member 10A, and hence the vending article G1 rolls while being separated from the outlet adjustment member 10A so as to be received and held in the holding portions 210A and 210B. When the loaded vending article G1 is landed on the article placement surface 21A of the first stopper member 2 near the base board 1 so as to contact the base board 1, the first stopper member 2 protrudes toward the article storage passage 83 so as to hold the vending article G1. In this state, since the first stopper member is inclined downward in relation to the horizontal line, the vending article G1 rolls while being separated from the base board 1 so as to be received and held in the holding portions 210A and 210B. In this case, when the vending article G1 rolls over the holding portions 210A and 210B till contacting the outlet adjustment member 10A, the vending article rolls while being separated from the outlet adjustment member 10A so as to be received and held in the holding portions 210A and 210B as described above. Then, the vending article G1 is held in a rolling manner in a state where the vending article is held in the holding portions 210A and 210B of the first stopper member 2, and hence the impact generated when the vending article collides with the next vending article G2 is distributed by the rolling vending article.

As described above, the article ejecting device of the automatic vending machine according to the embodiment of the invention is the article ejecting device 10 for the automatic vending machine mounted on the article storage rack 108 storing the articles while being laid sideways and stacked in the article storage passage 83 extending in the up and down direction. The article ejecting device 10 includes: the base board 1 forming one side of the article storage passage 83; the first stopper member 2 movable between the protruding position in which the first stopper member protrudes toward the article storage passage 83 so as to hold the article (the vending article G1) as a first vending target and the retractable position in which the first stopper member is retracted from the article storage passage 83 so as to release the holding of the vending article G1; and the second stopper member 3 movable between the protruding position in which the second stopper member protrudes toward the article storage passage 83 so as to hold the article (the next vending article G2) as a second vending target and the retractable position in which the second stopper member is retracted from the article storage passage 83. In the article ejecting device of the automatic vending machine disposed so as to face the outlet adjustment member 10A forming the other side of the article storage passage 83, the article placement surface 21A of the first stopper member 2 is provided with the holding portions 210, 210A, or 210B holding the vending article G1 in a rolling manner so that the vending article G1 does not contact the facing passage forming member (the base board 1 and the outlet adjustment member 10A) when only the vending article G1 is stacked without the next vending article G2 stacked thereon. Likewise, since the vending article G1 placed on the holding portion 210, 210A, or 210B of the first stopper member 2 is held in a rolling manner, it is possible to suppress the rebounding of the next vending article G2, that is, the reaction force to the next vending article G2 by distributing the impact generated when the next vending article G2 falls onto the vending article. Accordingly, there is an effect that the standing of the next vending article G2 can be prevented only by the improvement in the first stopper member 2.

Additionally, an example has been described in which the solenoid 5 is used as the driving units for the first stopper member 2 and the second stopper member 3 of the article ejecting device of the automatic vending machine of the above-described embodiment, but the driving unit may be a motor. Regarding the article loading operation, an example has been described in which the article is loaded from the state where no article exists in the article storage passage 83, but the invention can be applied to the case where the article stored in the article storage passage 83 is sold out and the article is loaded for the supplement thereof. That is, even in the state where the next vending article is loaded when the sold-out state of the article is detected by the operation of the sellout detection switch 8 detecting whether only one article (the vending article G1) is left in the article storage passage 83, the impact generated when the next vending article G2 (the first loaded article after the articles are sold out) falls onto the vending article is distributed since the vending article G1 placed on the holding portion 210, 210A, or 210B of the first stopper member 2 is held in a rolling manner. Accordingly, the rebounding of the next vending article G2, that is, the reaction force to the next vending article G2 can be suppressed. Thus, the invention is not limited to the embodiment.

The application claims priority of Japanese Patent Application No. 2014-227000 filed on Nov. 7, 2014, the disclosure of which is incorporated herein.

What is claimed is:

1. An article ejecting device of an automatic vending machine, comprising:

an article storage rack having an article storage passage for storing articles while being laid sideways and stacked in an up and down direction;

a base board forming one side of the article storage passage;

a first stopper member movable between a protruding position in which the first stopper member protrudes toward the article storage passage so as to hold a first vending article and a retractable position in which the first stopper member is retracted from the article storage passage so as to release holding of the first vending article;

a second stopper member movable between a protruding position in which the second stopper member protrudes toward the article storage passage so as to hold a second vending article and a retractable position in which the second stopper member is retracted from the article storage passage;

a closing plate separately formed from the second stopper member and rotationally attached to the base board above the second stopper member, and an outlet adjustment member forming another side of the article storage passage, wherein the first stopper member includes an article placement surface having a holding portion holding the first vending article in a rolling manner so that the first vending article does not contact the outlet adjustment member when only the first vending article is placed on the article placement surface without the second vending article stacked thereon, the second stopper member includes a shaft support portion having a pin insertion hole and rotatably supported at the base board, another holding portion having a tongue portion to hold the second vending article at the protruding position, and a stopper wall portion, the shaft support portion, the another holding portion, and the stopper wall portion being integrally formed as one member, and when the second stopper member protrudes at the protruding position, the closing plate is pushed to protrude together with the another holding portion into the article storage passage and interposed between the second vending article and the another holding portion of the second stopper member to fill a gap between the base board and the another holding portion, and when the second stopper member is retracted at the retractable position, the closing plate is drooped to overlap the second stopper member from the one side of the article storage passage.

2. The article ejecting device of the automatic vending machine according to claim 1, wherein the holding portion is an inverse trapezoidal recess portion formed on the article placement surface of the first stopper member.

3. The article ejecting device of the automatic vending machine according to claim 1, wherein the holding portion is a circular-arc recess portion formed on the article placement surface of the first stopper member.

4. The article ejecting device of the automatic vending machine according to claim 1, wherein the holding portion is a recess portion formed by an upward protruding protrusion portion provided in a front end of the first stopper member.

5. The article ejecting device of the automatic vending machine according to claim 1, further comprising:

a link member slidably attached to the base board, and connected to the second stopper member, a plunger attached to the link member to operate the link member, and a rotation stopper rotationally attached to the base board, and connected to the link member so that when the link member is actuated by the plunger, the rotation stopper is rotated to move the first stopper member to the retractable position, and the second stopper is rotated to the protrusion position to hold the second vending article thereon.

6. The article ejecting device of the automatic vending machine according to claim 5, wherein the rotation stopper includes another pin insertion hole for inserting a lock pin, the lock pin engaging and supporting the first stopper member.

7. The article ejecting device of the automatic vending machine according to claim 1, wherein the tongue portion is arranged such that when the article ejecting device and another article ejecting device are disposed back to back, the tongue portion engages another tongue portion of the another article ejecting device without being interfered each other.

8. The article ejecting device of the automatic vending machine according to claim 1, wherein the shaft support portion is arranged at a lower portion of the second stopper member, the another holding portion is arranged at an upper portion of the second stopper, and the stopper wall extends between the shaft support portion and the another holding portion;

the another holding portion has a width greater than that of the shaft support portion in a direction of a rotation axis of the second stopper member to form extension portions at sides of the another holding portion; and the tongue portion includes a plurality of tongue pieces arranged apart from each other to form spaces therebetween such that when the article ejecting device and another article ejecting device are disposed back to back, another plurality of tongue pieces of the another article ejecting device is arranged in the spaces without being interfered with the plurality of tongue pieces at the retractable position.

9. The article ejecting device of the automatic vending machine according to claim 1, wherein the base board includes a first protrusion portion protruding in the article storage passage above the closing plate, and the outlet adjustment member includes a second protrusion portion protruding toward the first stopper member in the article storage passage; and the first and second protrusion portions guide the second vending article such that a gravity center of the second vending article is not located at a position on an extension line of a gravity center of the first vending article.

10. The article ejecting device of the automatic vending machine according to claim 9, further comprising an article detection lever rotatably attached to the base board, and protruding in the article storage passage to suppress rebounding of the second vending article from the first second vending article.

* * * * *